US012709434B2

(12) United States Patent
Hoefte et al.

(10) Patent No.: US 12,709,434 B2
(45) Date of Patent: Aug. 18, 2026

(54) COVER, LOCK AND ALIGNMENT MARK

(71) Applicant: The Procter & Gamble Company, Cincinnati, OH (US)

(72) Inventors: Paulus Antonius Augustinus Hoefte, Astene (BE); Clara Lea Sophie Ng Pak Leung, Ixelles (BE)

(73) Assignee: The Procter & Gamble Company, Cincinnati, OH (US)

( * ) Notice: Subject to any disclaimer, the term of this patent is extended or adjusted under 35 U.S.C. 154(b) by 84 days.

(21) Appl. No.: 18/309,895

(22) Filed: May 1, 2023

(65) Prior Publication Data

US 2023/0286695 A1 Sep. 14, 2023

Related U.S. Application Data

(63) Continuation of application No. PCT/US2022/015411, filed on Feb. 7, 2022.

(30) Foreign Application Priority Data

Feb. 9, 2021 (EP) ..... 21156132

(51) Int. Cl.
*B65D 5/68* (2006.01)
*B65D 5/38* (2006.01)
(Continued)

(52) U.S. Cl.
CPC ..... *B65D 5/685* (2013.01); *B65D 5/38* (2013.01); *B65D 5/4212* (2013.01);
(Continued)

(58) Field of Classification Search
CPC ..... B65D 5/685; B65D 5/38; B65D 5/4212; B65D 5/6608; B65D 2203/12;
(Continued)

(56) References Cited

U.S. PATENT DOCUMENTS 117,349 A 7/1871 Tuttles
1,130,271 A 3/1915 Hammond
(Continued)

FOREIGN PATENT DOCUMENTS

EP 0454506 A1 10/1991
EP 1136372 A1 9/2001
(Continued)

OTHER PUBLICATIONS

Unpublished U.S. Appl. No. 18/469,978, filed Nov. 27, 2023, to Paulus Antonius Augustinus Hoefte et al.
(Continued)

*Primary Examiner* — Christopher R Demeree
(74) *Attorney, Agent, or Firm* — Abigail O. Idokogi; Andrew J. Mueller

(57) ABSTRACT

Examples include a consumer product comprising a detergent product and a container, the container comprising a box, a cover for the box, and a lock to reversibly maintain the cover in a closed position. The box comprises the detergent product, the box comprising a base, sidewalls and an opening, the cover comprising a top and flanks, the cover covering the opening and the cover covering at least a specific portion of a specific sidewall of the box when the cover is in the closed position. At least one of the flanks and sidewalls comprises an alignment mark coinciding with the cover being in the closed position.

14 Claims, 12 Drawing Sheets

(51) Int. Cl.
*B65D 5/42* (2006.01)
*B65D 5/66* (2006.01)

(52) U.S. Cl.
CPC ..... *B65D 5/6608* (2013.01); *B65D 2203/12* (2013.01); *B65D 2215/02* (2013.01); *B65D 2251/1016* (2013.01)

(58) Field of Classification Search
CPC ..... B65D 2215/02; B65D 2251/1016; B65D 2215/00; B65D 2215/06; B65D 5/68; B65D 5/6667; B65D 5/728; B65D 50/046; B65D 2215/04; B65D 2251/1066; B65D 2583/0468; B31B 50/88; B31B 2120/60
USPC ..... 229/124, 153, 102, 125.125, 145, 146, 229/162.6, 160.2; 206/264, 267, 273, 206/459.5; 40/312; 426/87
See application file for complete search history.

(56) References Cited

U.S. PATENT DOCUMENTS

| | | | | |
|---|---|---|---|---|
| 2,711,282 | A | 6/1955 | D'Espsito | |
| 2,777,630 | A * | 1/1957 | Moberger | B65D 43/0222 229/125.28 |
| 3,116,007 | A | 12/1963 | D'Espsito et al. | |
| 3,692,231 | A | 9/1972 | Neitzke et al. | |
| 4,684,023 | A * | 8/1987 | Cortopassi | B65D 5/6626 229/114 |
| 5,040,722 | A | 8/1991 | Fromion et al. | |
| 6,296,175 | B1 | 10/2001 | Dixon | |
| 7,581,643 | B2 * | 9/2009 | Wilskey | B65D 85/187 206/281 |
| 7,757,843 | B2 | 7/2010 | Katsis | |
| 8,714,348 | B2 * | 5/2014 | Vargas | A47G 19/2227 206/217 |
| 9,475,605 | B2 * | 10/2016 | Everett | B65D 59/04 |
| 9,783,335 | B2 | 10/2017 | Everett | |
| 9,881,788 | B2 | 1/2018 | Kim et al. | |
| 10,017,291 | B2 | 7/2018 | Smith et al. | |
| 10,232,976 | B2 * | 3/2019 | Waddington | B65D 5/728 |
| 10,486,849 | B2 * | 11/2019 | Parkes | B65D 5/6667 |
| 10,716,419 | B1 * | 7/2020 | Johnson | A47G 19/2227 |
| 10,934,072 | B2 | 3/2021 | Lantz et al. | |
| 11,046,476 | B2 * | 6/2021 | Whitehurst | B65D 79/00 |
| 11,794,947 | B2 | 10/2023 | Hoefte et al. | |
| 11,993,434 | B2 * | 5/2024 | Hoefte | B65B 5/024 |
| 12,116,184 | B2 * | 10/2024 | Hoefte | B65D 5/6667 |
| 12,134,503 | B2 * | 11/2024 | Hoefte | B65B 7/28 |
| 12,139,291 | B2 * | 11/2024 | Ruers | B65B 5/024 |
| 12,162,651 | B2 * | 12/2024 | Hoefte | B65D 5/48014 |
| 2007/0235511 | A1 | 10/2007 | Fitzwater | |
| 2008/0054059 | A1 * | 3/2008 | Chadima | B65D 5/685 229/102 |
| 2017/0036808 | A1 * | 2/2017 | Everett | B65D 5/38 |
| 2018/0022498 | A1 | 1/2018 | Everett | |
| 2018/0257827 | A1 | 9/2018 | Drosos et al. | |
| 2019/0062023 | A1 | 2/2019 | Lantz et al. | |
| 2019/0135503 | A1 * | 5/2019 | De Wilde | B65D 50/046 |
| 2021/0047072 | A1 | 2/2021 | Ng Pak Leung et al. | |
| 2021/0347524 | A1 | 11/2021 | Hoefte et al. | |
| 2022/0081155 | A1 | 3/2022 | Hoefte et al. | |
| 2022/0185534 | A1 | 6/2022 | Hoefte et al. | |
| 2022/0289436 | A1 | 9/2022 | Hoefte et al. | |
| 2022/0380086 | A1 | 12/2022 | Hoefte et al. | |
| 2023/0103439 | A1 | 4/2023 | Hoefte et al. | |
| 2023/0110630 | A1 | 4/2023 | Hoefte et al. | |
| 2023/0132541 | A1 | 5/2023 | Hoefte et al. | |
| 2023/0227186 | A1 | 7/2023 | Ruers et al. | |
| 2023/0257141 | A1 | 8/2023 | Ruers et al. | |
| 2023/0257145 | A1 | 8/2023 | Ruers et al. | |
| 2023/0264852 | A1 | 8/2023 | Hoefte et al. | |
| 2023/0264853 | A1 | 8/2023 | Hoefte et al. | |
| 2023/0322455 | A1 | 10/2023 | Beelen et al. | |
| 2023/0331447 | A1 | 10/2023 | Hoefte et al. | |

FOREIGN PATENT DOCUMENTS

| | | | |
|---|---|---|---|
| EP | 1783058 | B1 | 4/2010 |
| EP | 2808265 | A1 | 12/2014 |
| EP | 3587293 | A1 | 1/2020 |
| EP | 3753856 | A1 | 12/2020 |
| GB | 2358391 | A | 7/2001 |
| JP | 4536881 | B2 | 6/2010 |
| JP | 2010120693 | A | 6/2010 |
| WO | 0220361 | A1 | 3/2002 |
| WO | 2018022493 | A1 | 2/2018 |

OTHER PUBLICATIONS

Unpublished U.S. Appl. No. 18/506,351, filed Nov. 10, 2023, to Henri Theo Leonie Ruers et al.
Unpublished U.S. Appl. No. 18/541,249, filed Dec. 15, 2023, to Paulus Antonius Augustinus Hoefte et al.
PCT Search Report and Written Opinion for PCT/US2022/015411 dated May 9, 2022, 13 pages.
Extended European search report and search opinion for Application No. 21156132.9, dated Aug. 10, 2021, 09 pages.
"Washing Powder", Mintel, Retrieved from Internet: http://www.gnpd.com, Aug. 2020, 5 pages.
Third Party Opposition for 21156132.9 dated May 16, 2024, 23 pages.

* cited by examiner

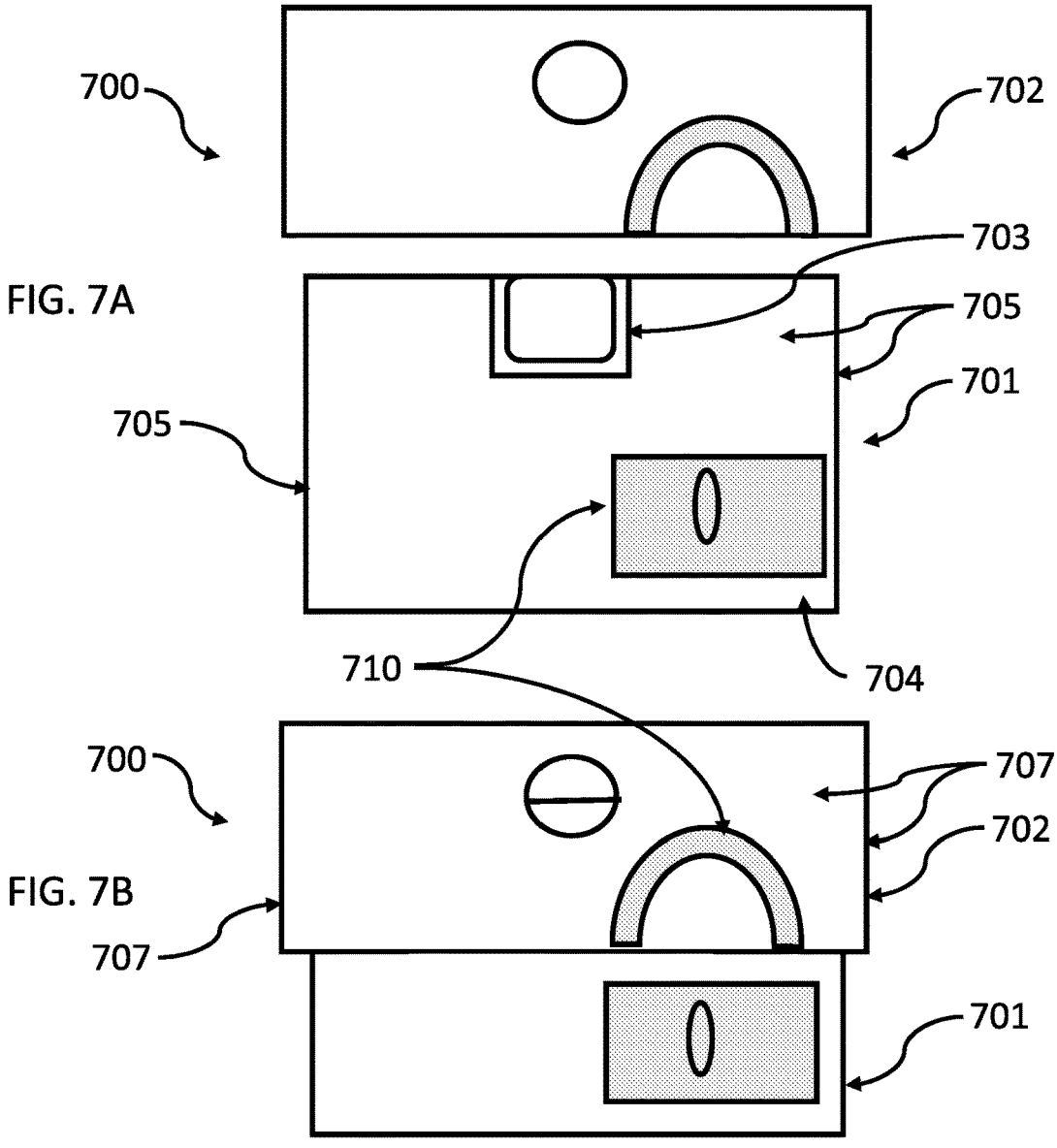
FIG. 7A
FIG. 7B
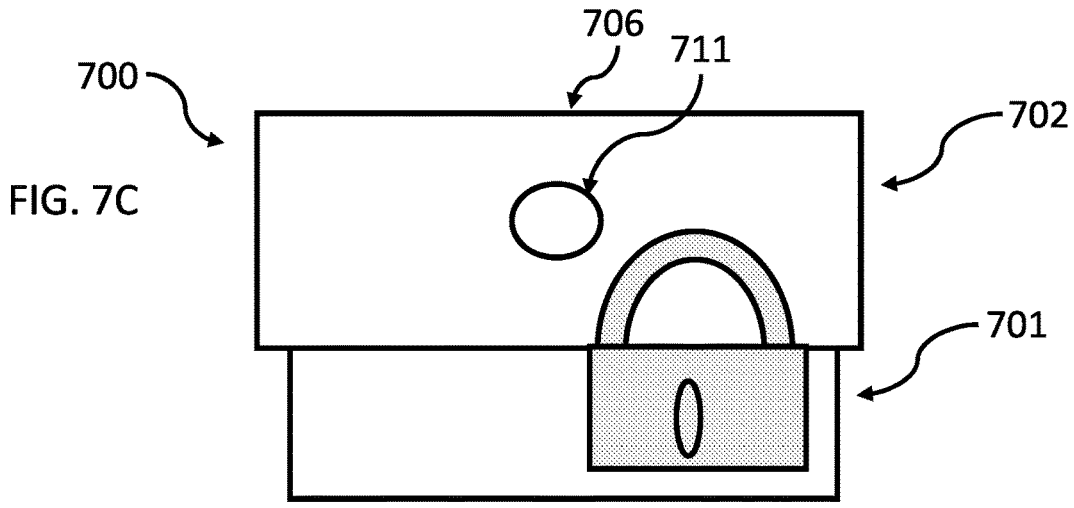
FIG. 7C

COVER, LOCK AND ALIGNMENT MARK

BACKGROUND

This invention generally relates to containers for detergent products. Such containers containing detergent products are consumer products present in consumer homes, in particular in rooms such as a kitchen, a laundry room or a bathroom, which tend to generate a humid environment. It is important that the container be configured to adequately protect the detergent product from degradation due to an excessive exposure to such moisture or humidity.

BRIEF DESCRIPTION OF THE DRAWINGS

FIG. 7A-C illustrate a seventh example consumer product.

DETAILED DESCRIPTION

Figure 1A:
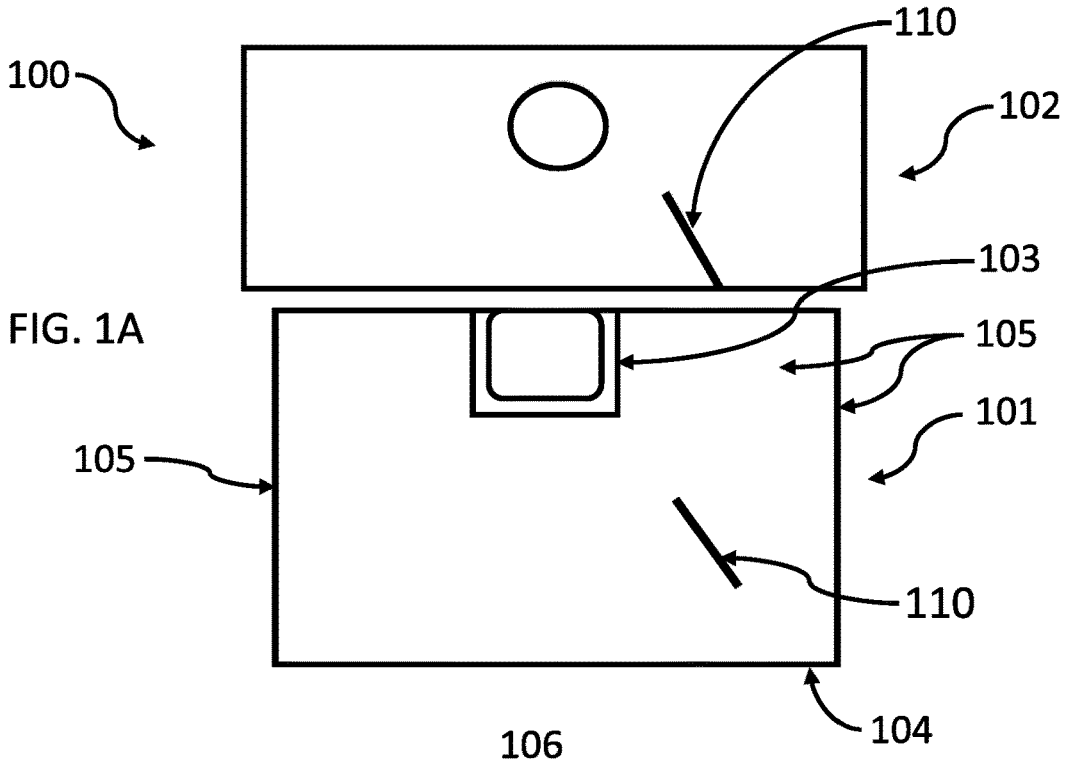
FIG. 1A-C illustrate a first example consumer product.

Detergent products are sensitive to humidity and should as such be contained in specific containers, in particular containers which may be locked and properly closed or locked following use or opening to reduce risks of detergent composition being overly exposed to environmental humidity. At the same time, a lock of such a container should be configured to be actuated by an ample variety of adult consumers or users. The lock should thereby reliably prevent accidental opening and reliable reclosing or relocking of the container after use, as well as provide for reliable unlocking when desired by an adult consumer. While such objectives may appear contradictory, it is important to get them both resolved. This apparent contradiction is particularly acute when applied to cardboard containers which, while offering desirable recyclability, introduce challenges related to their mechanical characteristics. The consumer product according to this disclosure aims at taking these different aspects into account.

The lock according to this disclosure is to reversibly maintain a cover in a closed position. By reversibly, it should be understood that the lock permits to repeatedly lock and unlock the cover, thereby permitting repeated access to the content of the container and permitting locking the container between successive access. This differs from, for example, one-off mechanisms such as tamper proof mechanisms which would, due to their function, not be reversible. In some examples, a lock according to this disclosure is to reversibly maintain a cover in a closed position by being configured to permit at least 10 successive opening and closing operations. In some examples, a lock according to this disclosure is to reversibly maintain a cover in a closed position by being configured to permit at least 50 successive opening and closing operations. In some examples, a lock according to this disclosure is to reversibly maintain a cover in a closed position by being configured to permit at least 100 successive opening and closing operations.

As will be described below, the specific configuration described in this disclosure permits relying on an alignment mark which will permit guiding a user such that a correct alignment mark placement corresponds to a correct locking operation. It can indeed be the case that a lock or lock mechanism for a container according to this description may be invisible to a user, such that a user may be unsure of whether locking may actually have taken place. The providing of the alignment mark as per this description will indicate that the locking is effective, even if the lock itself is invisible or hidden from sight.

Detergent products are products which may be relatively heavy, for example when a container for such product is carrying the full weight of such detergent products, in particular when the consumer product is recently acquired and thereby holds a significant quantity of detergent product. While some consumers may lift and transport such a consumer product holding a base of a box containing such detergent product, such lifting and transport may also occur by holding such consumer product by a cover, without holding the base. In such cases, it is possible that the cover, submitted to the force of gravity of the detergent product, gets released and opens the box, the box falling and possibly spreading its content. Such situations should be avoided. Beyond avoiding such unintentional cover unlocking, the structure of the container of a consumer product should preserve or improve opening ergonomics and prevent or reduce a permanent side wall deformation upon excessive or repetitive application of forces applied to the consumer product, for example during transport, in a grocery shopping bag against other objects, when submitted to external pressure, or when dropped. At the same time, containers may be elaborated in order to preserve the environment. The consumer product according to this disclosure aims at taking these different aspects into account.

A consumer product should in this disclosure be understood as a product which is provided, among others, to end consumers. Such consumer products may for example be available for purchase in supermarkets and end consumers may store such consumer products in their homes. Consumer products may be provided in large quantities and should thereby be designed taking environmental concerns into account. Consumer products should also be designed taking transportation to a retail store into account. Consumer products should also be robust to withstand transportation as part of an e-commerce shipment. Consumer products should also be designed taking on the shelf storage in a retail store into account. Consumer products should also be designed taking transportation from a retail store to a consumer home into account. Consumer products should also be designed taking storage at a private end-consumer home into account. Consumer products should also be designed taking use of the consumer product at a private end consumer home into account. Consumer products should also be designed taking disposal into account.

The consumer product according to this disclosure comprises a detergent product. Detergent products should be understood in this disclosure as products comprising a surfactant. Detergent products may also comprise a bleach or other ingredients. Example detergent product compositions are described in more detail herein. In some examples, the detergent product comprises unit dose detergent pouches, preferably water soluble unit dose detergent pouches, more preferably flexible water soluble unit dose detergent pouches. Example unit dose detergent pouches are described in more detail herein. One should note that in some cases, the containers according to this disclosure may also be suitable for content other than a detergent product, in particular for content of a perishable nature, such as food or unstable chemical substances for example.

The consumer product according to this disclosure further comprises a container. A container should be understood in this disclosure as an object housing a content, for example in a cavity of the container. The container facilitates protection, transport, storage, access and disposal of the consumer product.

In this disclosure, the container comprises a box. A box should be understood as a generally parallelepiped, barrel shaped, cylindrical, round, oval or cubical three dimensional object defining a cavity. The use of parallelepiped boxes may facilitate storage and transportation by permitting piling up boxes in a space efficient manner. In some examples, a box may be a parallelepiped provided with some rounded, tapered trapezium or chamfered edges. The box according to this disclosure comprises the detergent product. It should be understood that the detergent product is contained or stored in the box. The box according to this disclosure comprises a base, sidewalls and an opening. In some examples, the opening is opposite the base. In other examples the opening is on a sidewall. A base according to this disclosure should be understood as a surface on which the box may lie when placed on a supporting surface such as a shelf or a floor. In some examples, the base is flat. In some examples, the base is rectangular. In some examples, the base is oval or round. In some examples, the base has an embossed profile standing in or out in relief. The sidewalls according to this disclosure should be understood as extending from the base, and connecting the base to the opening, to a transition piece or to the cover. It should be understood that the connection of the base to the opening may include one or more transition pieces in addition to a sidewall. It should be understood that the connection of the base to the opening may be through a portion of a sidewall when, for example, the opening is in such sidewall. In some example, a transition piece may be glued or otherwise attached to the sidewall. In some examples, the sidewalls are perpendicular to the base. In some examples, the base is rectangular and has four sides, four sidewalls extending perpendicular from the base, each sidewall being rectangular, each side wall being connected by a sidewall side to a side of the base, and by two other sidewall sides to two other of the four sidewalls. In some examples the base is oval or circular and the sidewalls form a generally cylindrical wall extending from the base in a direction normal or perpendicular to the base. In some examples, sidewalls have a shape corresponding to one of a square, a rectangle, a trapeze, a polygon, a section of a sphere, a section of an ovoid, or a section of an ellipsoid. The opening according to this disclosure should be understood as a complete or partial aperture providing access to the detergent product comprised in the box. In some examples, the opening faces the base. In some examples, the opening has a surface of less than the surface of the base. In some examples, the opening has a surface larger than the surface of the base in order to provide an improved access, for example using sidewalls extending from the base at angle of more than 90 degrees from the base. In some examples, the opening is provided after removal of a tamper proof feature, for example comprising a perforated piece to be removed at first use or a tamper evident sticker locking a cover to the box. In some examples a tamper evident sticker is glued on the cover and on the box, whereby the tamper evident sticker should be broken, teared or perforated at first opening to indicate to a consumer that the container has not been tempered with before purchase. This temper evident sticker may for example be in paper or in plastic. In some examples, the opening is placed on a top panel of the box, the top panel of the box facing, i.e. opposite, the base of the box, the top panel of the box being separated from the base of the box by at least the sidewalls, the top panel of the box being generally coplanar with the base of the box. In some examples, the opening is in a sidewall, the opening having an opening profile or an opening contour which may be comprised in a plane normal to the plane of the base. In some examples, the opening is rectangular. In some examples, the opening is rectangular with rounded edges. In some examples, the opening is round or oval. In some examples, the opening is a permanent opening. In some examples, the opening is a reclosable opening. Examples reclosable opening comprise openings reclosable by a single flap, or reclosable opening reclosable through a spout like structure, for example a spout like structure comprising a main flap which, in a reclosed position, would cover the opening, and side elements which, when the opening is open, link the main flap with sides of the opening.

The container comprises a cover for the box. The cover according to this disclosure should be understood as an element permitting to repeatedly close or open the opening of the box. In some examples the cover may be connected to the box, for example by a hinge, or may be separated from the box. The cover according to this disclosure comprises a top or cover top and flanks or cover flanks. In some examples, in addition to a top and flanks, the cover comprises a further panel, the top, flanks and further panel forming a sleeve surrounding the box. It should be understood that the cover is aimed at covering the opening of the box when the cover is in a closed position. In some examples, the top of the cover is rectangular. In some examples the top of the cover is round, hexagonal, octagonal, polygonal or oval, structures such as round or oval being for example approximated by multiplying a number of side panels and cover flaps. In some examples, the cover comprises beveled edges. In some examples, the top of the cover is rectangular with rounded edges. It should be understood that while being named "top", the top of the cover may be positioned in different orientations. The cover comprises flanks. It should be understood that the flanks according to this disclosure are elements connected to the top of the cover and extending from the cover in order to engage one or more sidewalls of the box, each flank having an extension along a corresponding sidewall between the connection to the top of the cover and a distal end of the flank. The flanks participate in placing the top of the cover onto the opening. In some examples, the flanks extend perpendicularly from the top of the cover. In some examples, the flanks surround an entire perimeter of the top of the cover. In some examples, the flanks partially surround an entire perimeter of the top of the cover, a portion of the top of the cover being flankless, for example along a hinge between the cover and the box in a case of a hinged cover. In some examples, the cover forms a sleeve. The top of the cover or another part of the cover may cover the opening, and at least a portion of the flanks or another part of the cover may cover at least a specific portion of a specific sidewall of the sidewalls of the box when the cover is in the closed position, the cover being moveable from the closed position to an open position. Movement of the cover may be restrained by a connection to the box such as a hinge, or may be entirely removable, for example to provide an improved access to the content of the box. The box and cover cooperate to participate in fulfilling the role of the container to store, transport and facilitate access to the content of the container.

The container according to this disclosure comprises a lock to reversibly maintain the cover in a closed position. Reversibility should be understood in that the lock may repeatedly be opened or closed. A lock should be in this disclosure understood as a mechanism providing appropriate closure and protection of detergent composition from humidity, as well as preventing or reducing the likelihood of an accidental opening. The lock according to this disclosure is to maintain the cover in a closed position. It should be understood that the lock according to this disclosure is expected to function under normal use of the container. It should be understood that the lock may not fulfill its function when for example unusual use is made of the box, or when the box is under unusual conditions. In some examples, the lock comprises an actuator moveable from a locking position to an opening position by applying an actuation pressure onto the actuator when the cover is in the closed position. An example actuator is a mechanical structure submitted to a movement upon actuation by an outside force or actuation pressure, such movement leading to the opening of the lock when such movement takes place. In some examples, the actuator is resilient and has a default position, such default position corresponding to the cover remaining closed, a resilience being vanquished by an outside force or actuation pressure in order to open the cover. In some examples, the actuator is resilient in that the actuator comprises a flexible element, the flexible element having a default position corresponding to the cover remaining closed, the flexible element being pressed to open the cover, the flexible element springing back to the default position when releasing pressure. It should be understood that a pressure is generated by the application of a force onto a surface. Example actuators have at least two positions being the opening position and the locking position, whereby the opening position corresponds to a position permitting opening of the cover, the locking position preventing opening of the cover to protect the content from humidity or reducing the possibility of an accidental opening of the cover.

An example actuator is connected to the specific portion being the at least specific portion of a specific sidewall of the sidewalls of the box covered by at least a portion of the cover when the cover is in the closed position, which may be a specific portion covered by at least a portion of the cover when the cover is in the closed position, the actuator abutting for example against a locking tab of the cover when in the locking position, the actuator being for example maintained away from the locking tab when in the opening position, the actuator being for example displaceable by the actuation pressure by an unlocking displacement distance in a direction normal to the specific portion of the sidewalls. The connection to the specific portion may for example be a fold line at an end of a sidewall away from the base. The connection of the actuator to the specific portion of the sidewall is due to the actuator participating in locking or unlocking the specific portion of the sidewall from the portion of the cover covering the specific portion of the sidewall, thereby permitting releasing the cover from the box. The cover may comprise a locking tab. A locking tab should be understood as a mechanical element which interlocks with the actuator. In some examples the locking tab extends away from part of the cover and may be in the form of a bulge, a ridge, an embossment or an additional material layer sticking out of the cover and towards the specific portion of the side wall such that the actuator may abut against the tab when in the locking position to prevent separating the specific portion of the sidewalls from the cover in the area of the actuator. In some examples, the locking tab is comprised in the cover itself, the locking tab being for example formed by an aperture in the cover. Abutment according to this disclosure should be understood as a contact between the actuator or part of the actuator and the tab, such contact preventing opening of the cover. In some examples the actuator is maintained away from the locking tab when in the opening position, in order to release the locking tab. Such release of the locking tab permits opening the cover. Displacement or movement of the actuator from the locking to the opening position is by application on the actuator (directly or indirectly) of an actuation pressure or force such that the actuator is displaced by a distance sufficient to supress contact of the actuator with the locking tab, such distance corresponding to the displacement distance, in a direction normal to the specific portion of the side wall. Such force or pressure may also comprise a minor component which may be parallel to the side wall, due to the fact that the hand is a human adult hand which does not necessarily align force completely perfectly. The actuation is however triggered by a component of such force or pressure being normal to the portion of the side wall. Such presence requirement of a component normal to the portion of the sidewall in order to unlock the lock, participates in the role of the lock of avoiding an accidental opening, for example in absence of such normal force component, whereas desired opening would take place by the consumer "pushing" the actuator and apply the unlocking force or pressure permitting opening of the cover.

In order to provide precision in locating a finger appropriately, the flanks comprise an actuation area in a specific flank, the actuation area facing the actuator. The fact that such actuation area faces the actuator indeed permits locating either the thumb or one or more of the other fingers on exactly the area on which a lock opening force should be applied. The actuation area should be understood as defining a localised discontinuity on the specific flank, whereby a user or consumer may perceive such discontinuity in order to correctly locate the thumb or one or more other fingers. Such discontinuity may comprise one or more of an actuation aperture, an actuation flap, an actuation slit, an actuation membrane, or tactile elements comprised in or applied to a surface of the flank such as embossments, debossments, surface texturing, buttons or the like. In some examples, the actuation area or the specific portion comprises a visual indication indicating the location of the actuation area. In some examples whereby the actuation area is an aperture, the specific portion comprises a visual indication visible through the aperture, respectively apertures, when the cover is closed. The visual indication may be printed on an external surface of the flanks and may comprise one or more arrows or one or more areas printed in a striking colour or a specific text providing instructions such as "push here to open" for example, or a combination of any of these indications. The actuation area is configured to permit displacing the actuator from the locking position to the opening position by applying the actuation pressure at the actuation area when the cover is in the closed position. In order to appropriately place the thumb or one or more other fingers, the actuation area can span less than 8 $cm^2$ and more than 0.2 $cm^2$. It was found that a larger area would lead to lack of precision in finger placement, and that a smaller area would lead to the actuation area being difficult to locate for a user or consumer. In some examples, the actuation area has a circular shape in order to ease positioning. Other shapes may be considered such as, for example, elliptical, oval, square, triangular, square with rounded corners, triangular with rounded corners, other polygonal shapes or other polygonal shapes with rounded corners.

Figure 1B:
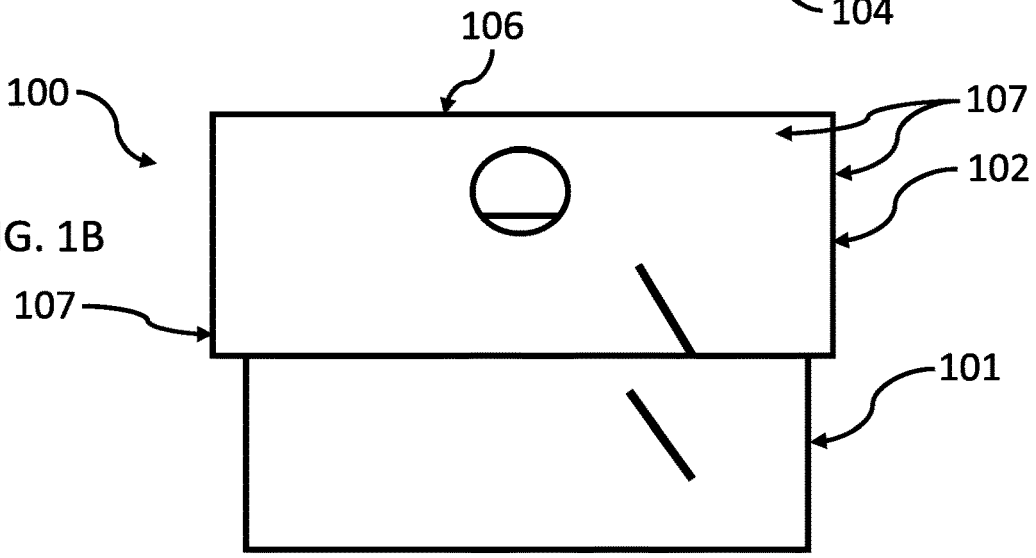
Figure 1C:
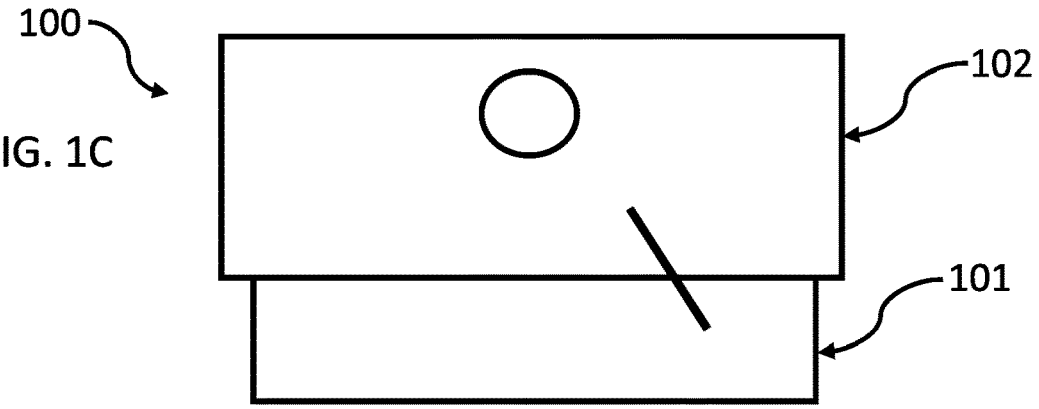

FIGS. 1A-1C illustrate an example consumer product 100 according to this description. Consumer product 100 is open in FIG. 1A, closed in FIG. 1C, and in an intermediate position in FIG. 1B. Consumer product 100 comprises a detergent product (not visible in these Figures) and a container, the container comprising a box 101, a cover 102 for the box, and a lock 103 to reversibly maintain the cover in a closed position, the box comprising the detergent product, the box comprising a base 104, sidewalls 105 and an opening, the opening being in this example opposite the base, the box having a general shape in this example similar to a shoe box, the cover comprising a top 106 and flanks 107, the cover covering the opening and the cover covering at least a specific portion of a specific sidewall of the box when the cover is in the closed position, whereby at least one of the flanks and sidewalls comprises an alignment mark 110 coinciding with the cover being in the closed position. In this example, both the flanks and sidewall comprise an alignment mark 110. As illustrated in the succession of FIGS. 1A to 1C, the alignment marks 110 are in this case corresponding to a mark on the cover and to a mark on the box, both marks coinciding to form a single mark when the cover is closed, such coincidence confirming closure of the container and thereby adequate protection of the content.

As illustrated in this and in other examples, the alignment mark should be understood as a graphical or tactile feature, or a feature both graphical and tactile, coinciding with the cover being in the closed position. Such coincidence may take place between different elements or marks as illustrated in FIGS. 1A-C or may take place between an alignment mark and a feature of the container such as, for example, a distal end of a flank as illustrated for example in FIGS. 2A-C. In some examples, the alignment mark comprises a feature such as a segment, a pattern, a line or a curve which, when the cover is closed, coincides with a corresponding feature, whereby such corresponding feature may be another alignment mark, or a structural feature such as a border, extremity, aperture or slit of the container.

Figure 2A:
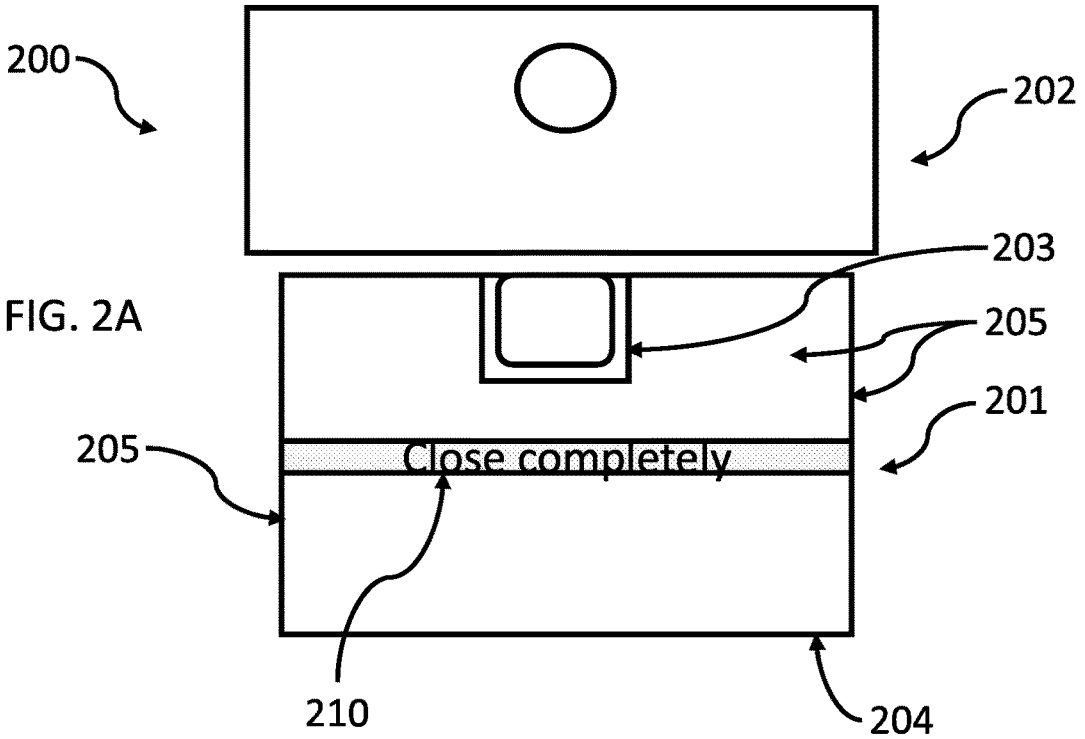
FIG. 2A-C illustrate a second example consumer product.
Figure 2B:
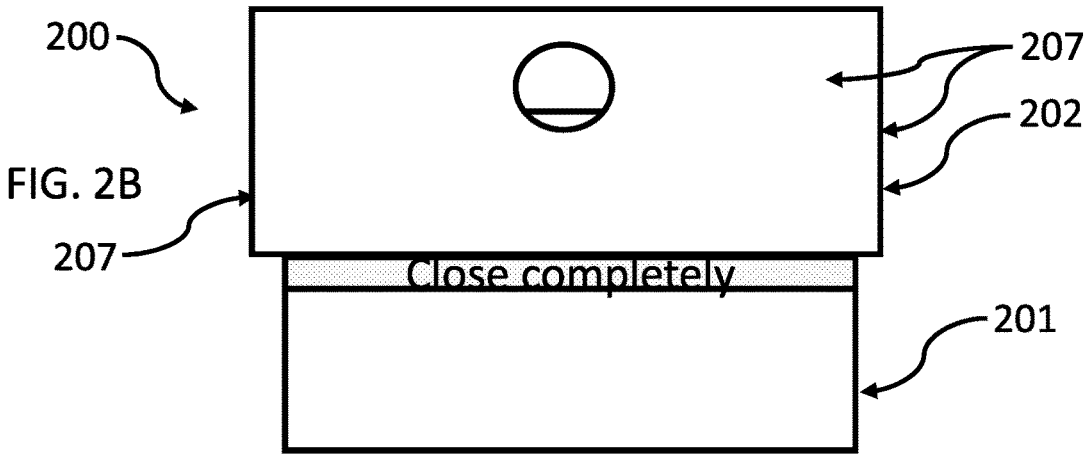
Figure 2C:
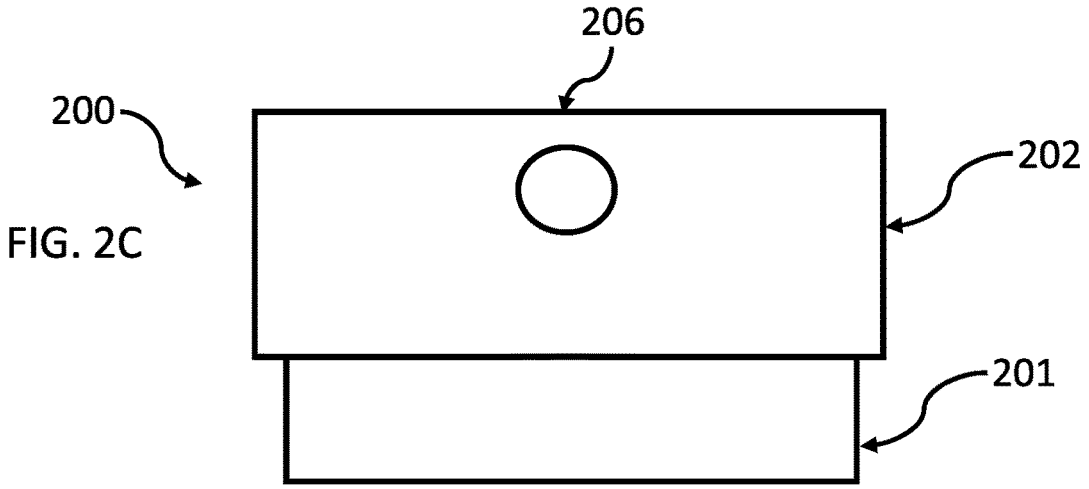

FIGS. 2A-C illustrate an example consumer product 200 according to this description. Consumer product 200 is open in FIG. 2A, closed in FIG. 2C, and in an intermediate position in FIG. 2B. Consumer product 200 comprises a detergent product (not visible in these FIGS. and a container, the container comprising a box 201, a cover 202 for the box, and a lock 203 to reversibly maintain the cover in a closed position, the box comprising the detergent product, the box comprising a base 204, sidewalls 205 and an opening, the opening being in this example opposite the base, the box having a general shape in this example similar to a shoe box, the cover comprising a top 206 and flanks 207, the cover covering the opening and the cover covering at least a specific portion of a specific sidewall of the box when the cover is in the closed position, whereby at least one of the flanks and sidewalls comprises an alignment mark 210 coinciding with the cover being in the closed position. In this example, the sidewall of the box comprises the alignment mark 210. As illustrated in the succession of FIGS. 2A to 2B, the alignment mark 210 is in this case corresponding to a text appearing on a sidewall of the box, the text being hidden by the cover when the cover is closed, as illustrated in FIG. 2C, such coincidence between, in this case, a flank of the cover, and the alignment mark 210 confirming closure of the container and thereby adequate protection of the content.

Figure 3A:
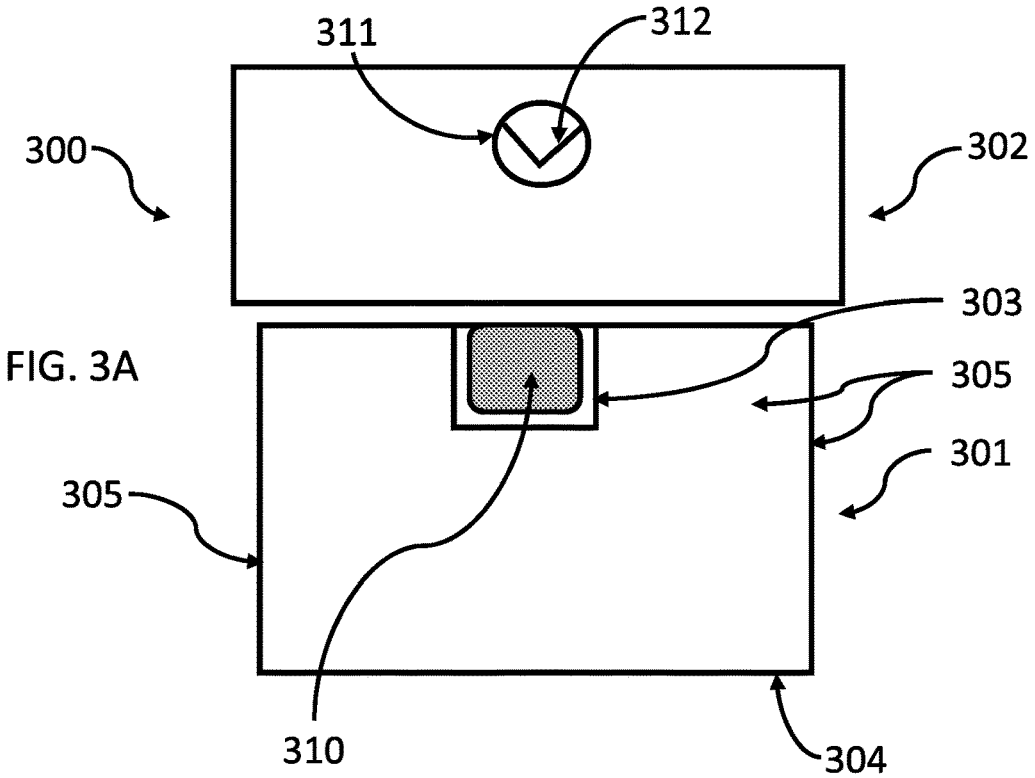
FIG. 3A-C illustrate a third example consumer product.
Figure 3B:
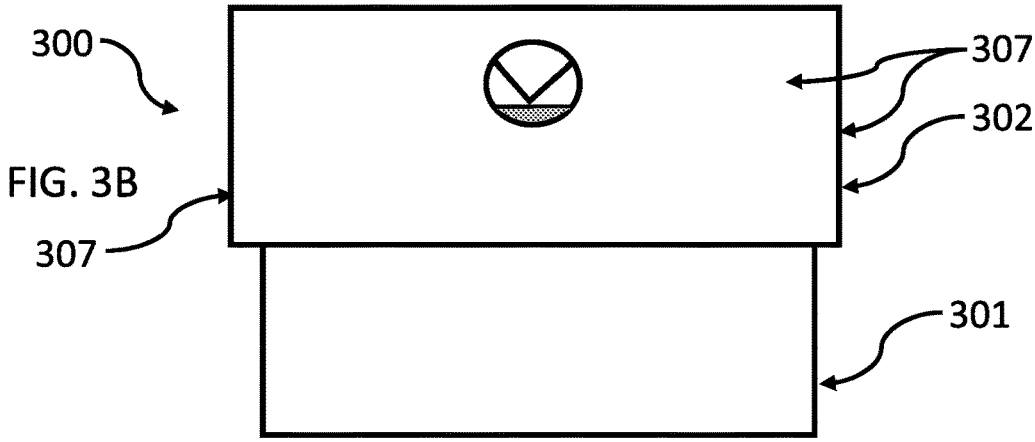
Figure 3C:
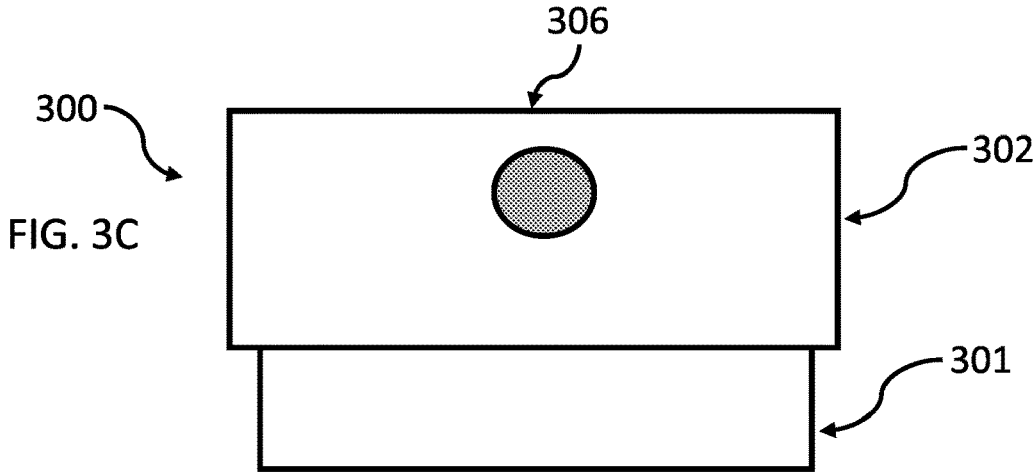

FIGS. 3A-C illustrate an example consumer product 300 according to this description. Consumer product 300 is open in FIG. 3A, closed in FIG. 3C, and in an intermediate position in FIG. 3B. Consumer product 300 comprises a detergent product (not visible in these Figures) and a container, the container comprising a box 301, a cover 302 for the box, and a lock 303 to reversibly maintain the cover in a closed position, the box comprising the detergent product, the box comprising a base 304, sidewalls 305 and an opening, the opening being in this example opposite the base, the box having a general shape in this example similar to a shoe box, the cover comprising a top 306 and flanks 307, the cover covering the opening and the cover covering at least a specific portion of a specific sidewall of the box when the cover is in the closed position, whereby at least one of the flanks and sidewalls comprises an alignment mark 310 coinciding with the cover being in the closed position. In this example, the sidewall of the box comprises the alignment mark 310 in the region of the lock 303. As illustrated in the succession of FIGS. 3A to 3B, the alignment mark 310 is in this case corresponding to an area coloured or printed in a colour different from other sidewall areas, the alignment mark 310 becoming visible through a circular aperture 311, the circular aperture corresponding in this case to an actuation area through which an actuation pressure may be applied to unlock lock 303 when cover 302 is closed. One should note that such actuation area my take other shapes or may comprise a see-through membrane. Such actuation area not only permits actuating the lock, but also acts as an element coinciding with the alignment mark when the cover is closed, as illustrated in FIG. 3C, such coincidence between, in this case, the actuation area 311 in a flank, and the alignment mark 310 confirming closure of the container and thereby adequate protection of the content. In some examples, the colour difference between the alignment mark and a surrounding area is obtained by using for the alignment mark and for the surrounding area an opponent colour pair in order to facilitate identifying the coincidence, for example:

| Example | Alignment Mark Color | Surrounding Area Color |
|---|---|---|
| A | Black | Yellow |
| B | Yellow | Black |
| C | Red | Green |
| D | Green | Red |
| E | Black | White |
| F | White | Black |

One should note that such color pairing easing the identification of an alignment mark may be implemented in other examples hereby described.

One should note that in the example of FIGS. 3A-C, the container further comprises a support element structure 312 entering the opening of the box when the cover is in the closed position, as will be described in more details in further sections of this disclosure. Such support element structure 312 is in this example visible through aperture 311. Such visibility of the support element structure 312 through the aperture 311 permits leveraging such support element structure as an additional alignment mark, confirming closure when such support element structure is visibly aligned through the aperture 311.

Figure 4A:
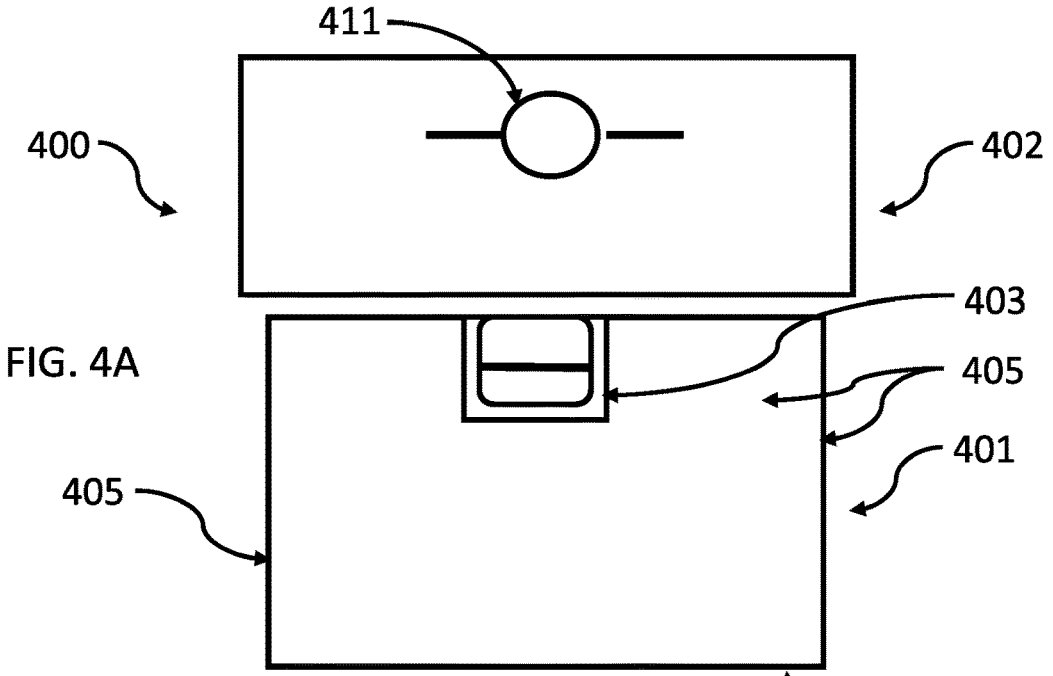
FIG. 4A-C illustrate a fourth example consumer product.
Figure 4B:
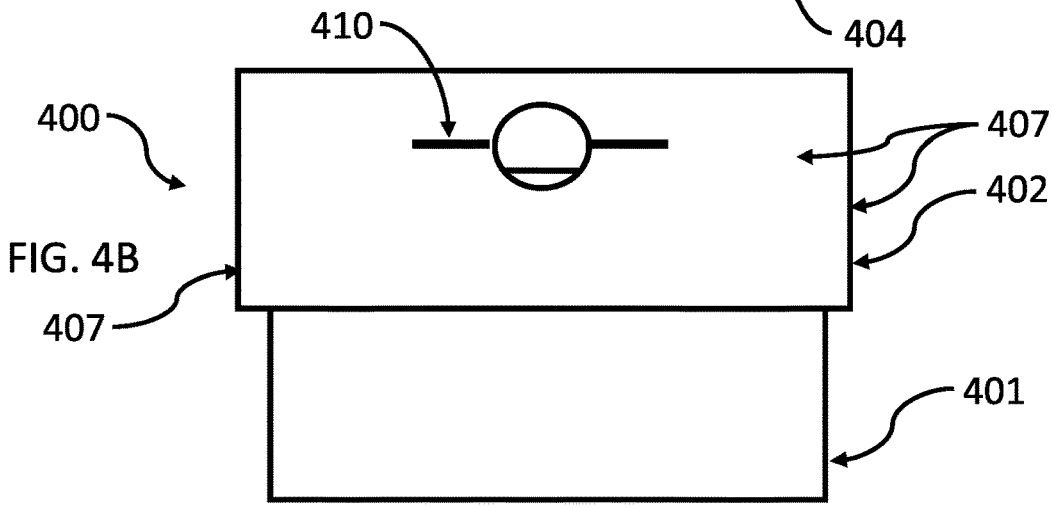
Figure 4C:
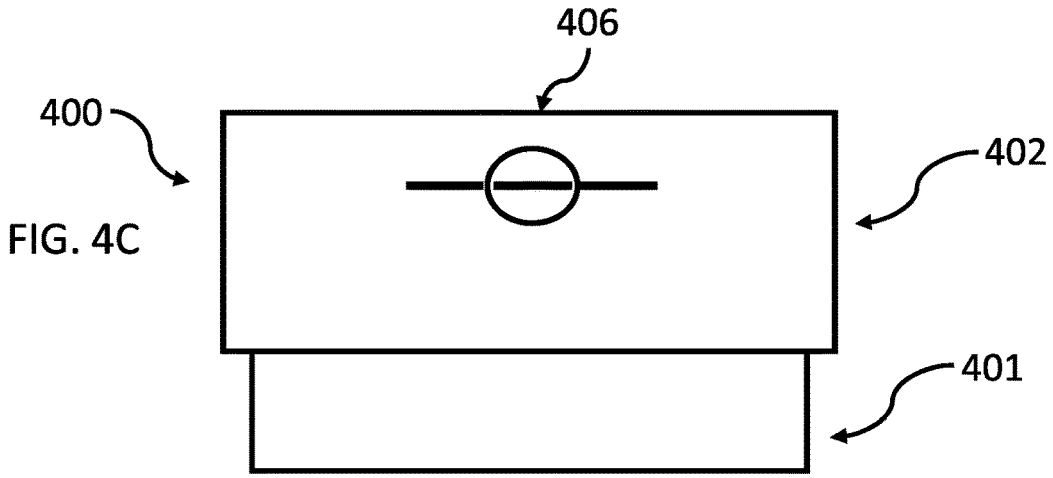

FIGS. 4A-C illustrate an example consumer product 400 according to this description. Consumer product 400 is open in FIG. 4A, closed in FIG. 4C, and in an intermediate position in FIG. 4B. Consumer product 400 comprises a detergent product (not visible in these Figures) and a container, the container comprising a box 401, a cover 402 for the box, and a lock 403 to reversibly maintain the cover in a closed position, the box comprising the detergent product, the box comprising a base 404, sidewalls 405 and an opening, the opening being in this example opposite the base, the box having a general shape in this example similar to a shoe box, the cover comprising a top 406 and flanks 407, the cover covering the opening and the cover covering at least a specific portion of a specific sidewall of the box when the cover is in the closed position, whereby at least one of the flanks and sidewalls comprises an alignment mark 410 coinciding with the cover being in the closed position. In this example, the flank of the cover comprises the alignment mark 410. As illustrated in the succession of FIGS. 4A to 4B, the alignment mark 410 is in this case corresponding to a line interrupted by an actuation area 411 in the form of an aperture or translucid membrane, whereby such alignment mark becomes aligned with an end of a sidewall of the box as illustrated in FIG. 4C, such alignment being visible through the actuation area 411. In this example, the alignment takes place between the alignment mark and a structural element of the box, such structural element and alignment mark coinciding at a same level when the box is properly closed, such coincidence being, as in other examples, visible by a user.

Figures 5A, 5B, 5C:
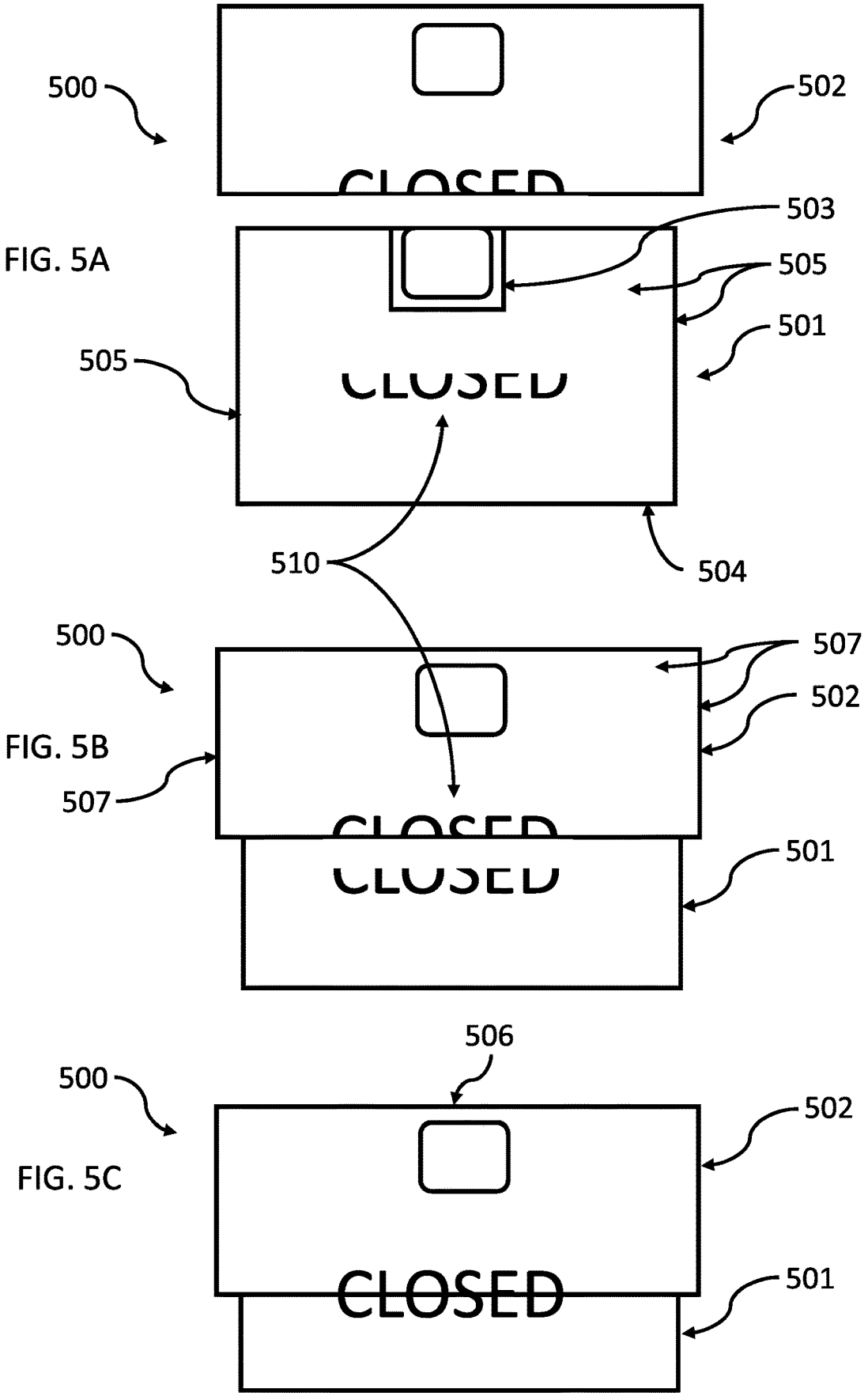
FIG. 5A-C illustrate a fifth example consumer product.

FIGS. 5A-C illustrate an example consumer product 500 according to this description. Consumer product 500 is open in FIG. 5A, closed in FIG. 5C, and in an intermediate position in FIG. 5B. Consumer product 500 comprises a detergent product (not visible in these Figures) and a container, the container comprising a box 501, a cover 502 for the box, and a lock 503 to reversibly maintain the cover in a closed position, the box comprising the detergent product, the box comprising a base 504, sidewalls 505 and an opening, the opening being in this example opposite the base, the box having a general shape in this example similar to a shoe box, the cover comprising a top 506 and flanks 507, the cover covering the opening and the cover covering at least a specific portion of a specific sidewall of the box when the cover is in the closed position, whereby at least one of the flanks and sidewalls comprises an alignment mark 510 coinciding with the cover being in the closed position. In this example, both the sidewall of the box and a corresponding flank of the cover comprise an alignment mark 510. In this example, the alignment mark comprises text, in this example, portion of a word, specifically the word "closed". As illustrated in the succession of FIGS. 5A to 5C, the alignment marks 510 in this case form the complete word "CLOSED" when the cover is properly closed. One should note that in this example and in other examples, other sides of the box or covers may comprise such or other alignment marks.

Figure 6A:
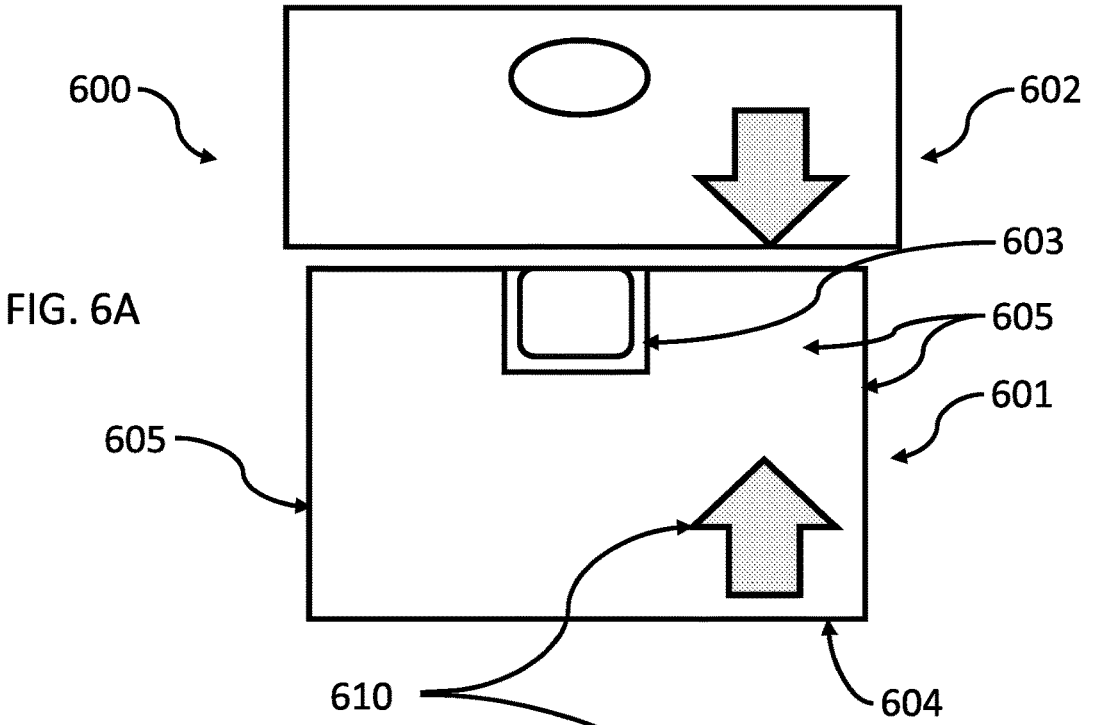
FIG. 6A-C illustrate a sixth example consumer product.
Figure 6B:
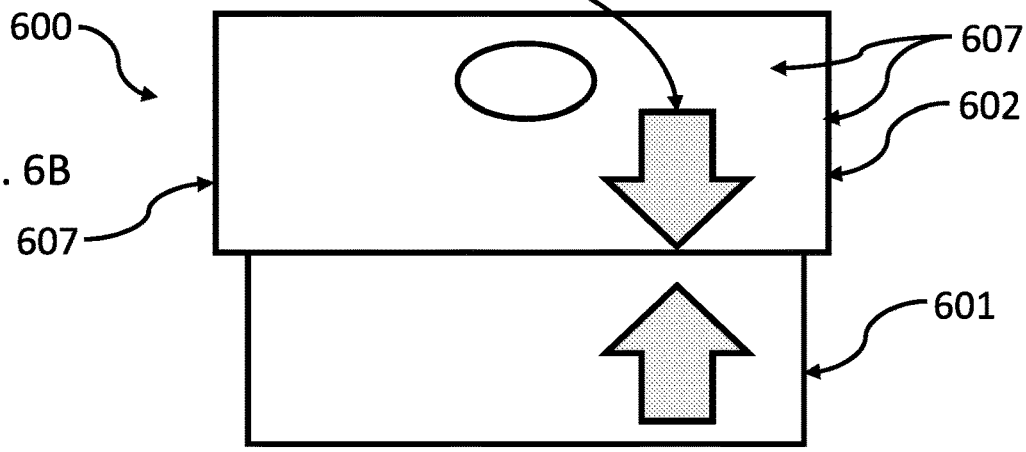
Figure 6C:
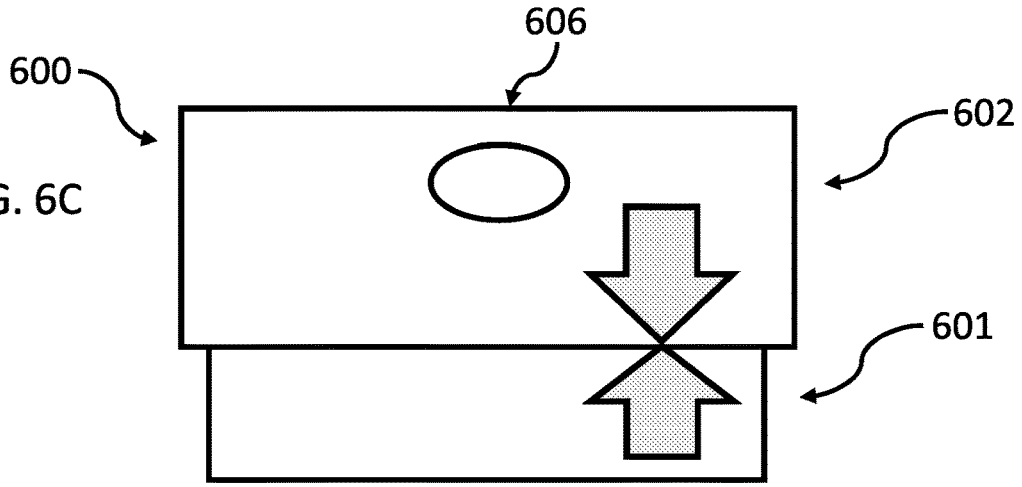

FIGS. 6A-C illustrate an example consumer product 600 according to this description. Consumer product 600 is open in FIG. 6A, closed in FIG. 6C, and in an intermediate position in FIG. 6B. Consumer product 600 comprises a detergent product (not visible in these Figures) and a container, the container comprising a box 601, a cover 602 for the box, and a lock 603 to reversibly maintain the cover in a closed position, the box comprising the detergent product, the box comprising a base 604, sidewalls 605 and an opening, the opening being in this example opposite the base, the box having a general shape in this example similar to a shoe box, the cover comprising a top 606 and flanks 607, the cover covering the opening and the cover covering at least a specific portion of a specific sidewall of the box when the cover is in the closed position, whereby at least one of the flanks and sidewalls comprises an alignment mark 610 coinciding with the cover being in the closed position. In this example, both the sidewall of the box and a corresponding flank of the cover comprise an alignment mark 610. In this example, each alignment mark comprises a symbol, in this case an arrow, whereby a first arrow is visible on the cover and a second arrow is visible on the box, the arrows pointing to each other, the arrows being joined at their tip when the cover is closed.

FIGS. 7A-C illustrate an example consumer product 700 according to this description. Consumer product 700 is open in FIG. 7A, closed in FIG. 7C, and in an intermediate position in FIG. 7B. Consumer product 700 comprises a detergent product (not visible in these Figures) and a container, the container comprising a box 701, a cover 702 for the box, and a lock 703 to reversibly maintain the cover in a closed position, the box comprising the detergent product, the box comprising a base 704, sidewalls 705 and an opening, the opening being in this example opposite the base, the box having a general shape in this example similar to a shoe box, the cover comprising a top 706 and flanks 707, the cover covering the opening and the cover covering at least a specific portion of a specific sidewall of the box when the cover is in the closed position, whereby at least one of the flanks and sidewalls comprises an alignment mark 710 coinciding with the cover being in the closed position. In this example, both the sidewall of the box and a corresponding flank of the cover comprise an alignment mark 710. In this example, each alignment mark comprises a symbol, in this case part of a lock or padlock, whereby a first part is visible on the cover and a second part is visible on the box, the padlock appearing as closed when the cover is closed. In this example, one also may observe, through aperture 711, the sidewall of the box being progressively blocking the aperture (see for example the border of such side wall through the aperture 711 in FIG. 7B), thereby providing an additional alignment mark leading to appropriate closure of the lock.

Figure 8A:
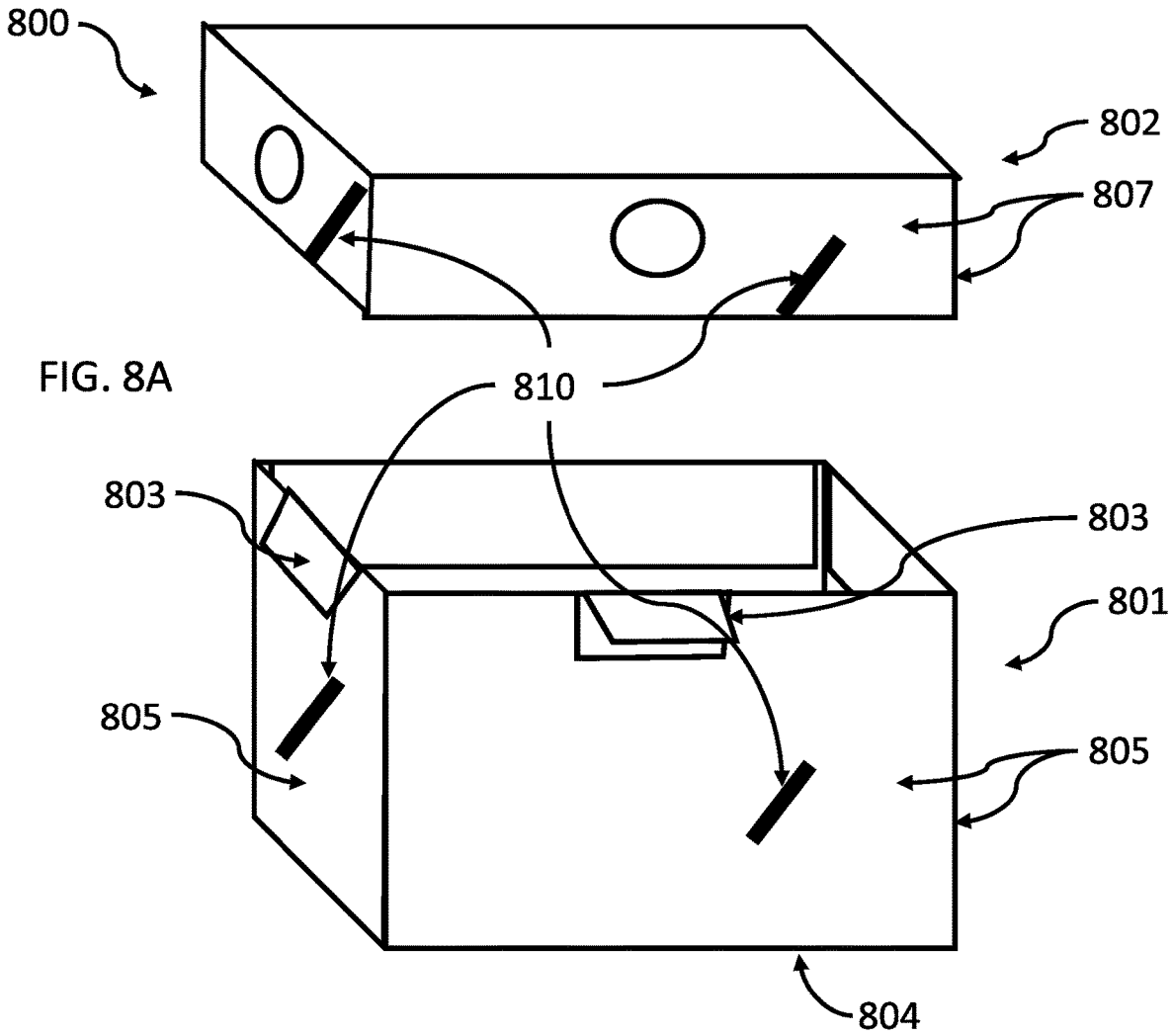
FIG. 8A-B illustrate an eighth example consumer product.
Figure 8B:
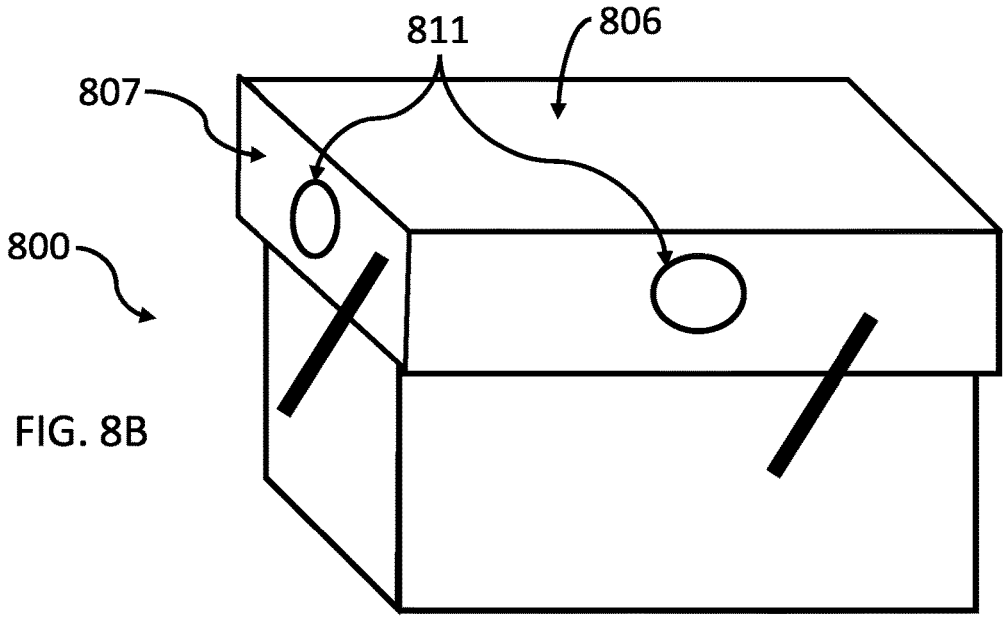

FIGS. 8A-B illustrate an example consumer product 800 according to this description. Consumer product 800 is open in FIG. 8A, closed in FIG. 8B. Consumer product 800 comprises a detergent product (not visible in these Figures) and a container, the container comprising a box 801, a cover 802 for the box, and, in this example, two different locks 803 placed on different sidewalls of the box. In this example, locks 803 comprise flaps cooperating with corresponding tabs on flanks of the cover, the locks 803 being unlocked through corresponding apertures 811 in the flanks of the cover, the apertures corresponding to actuation areas. Note that in this example, the locks are placed on adjacent sidewalls, in particular for illustration purposes. In other examples, locks may be placed on opposite sidewalls. The locks 803 permit to reversibly maintain the cover in a closed position, the box comprising the detergent product, the box comprising a base 804, sidewalls 805 and an opening, the opening being in this example opposite the base, the box having a general shape in this example similar to a shoe box, the cover comprising a top 806 and flanks 807, the cover covering the opening and the cover covering at least a specific portion of a specific sidewall of the box when the cover is in the closed position, whereby at least one of the flanks and sidewalls comprises an alignment mark 810 coinciding with the cover being in the closed position. In this example, a plurality of alignment marks 810 are provided, each lock 803 being in this case associated with respective alignment marks. alignment marks 810 coincide as aligned when the cover is closed as illustrated in FIG. 8B. Providing several locks and associated alignment marks provides for improved locking performance.

Figure 9A:
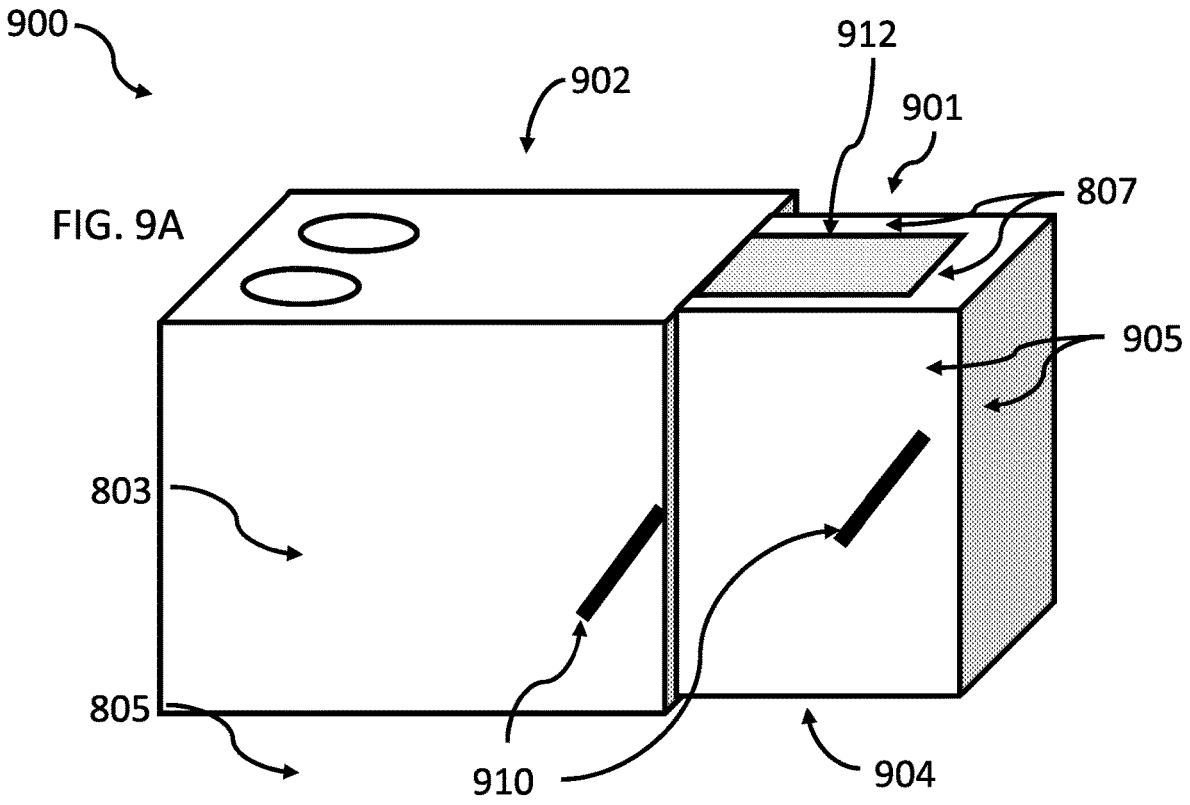
FIG. 9A-B illustrate a ninth example consumer product.
Figure 9B:
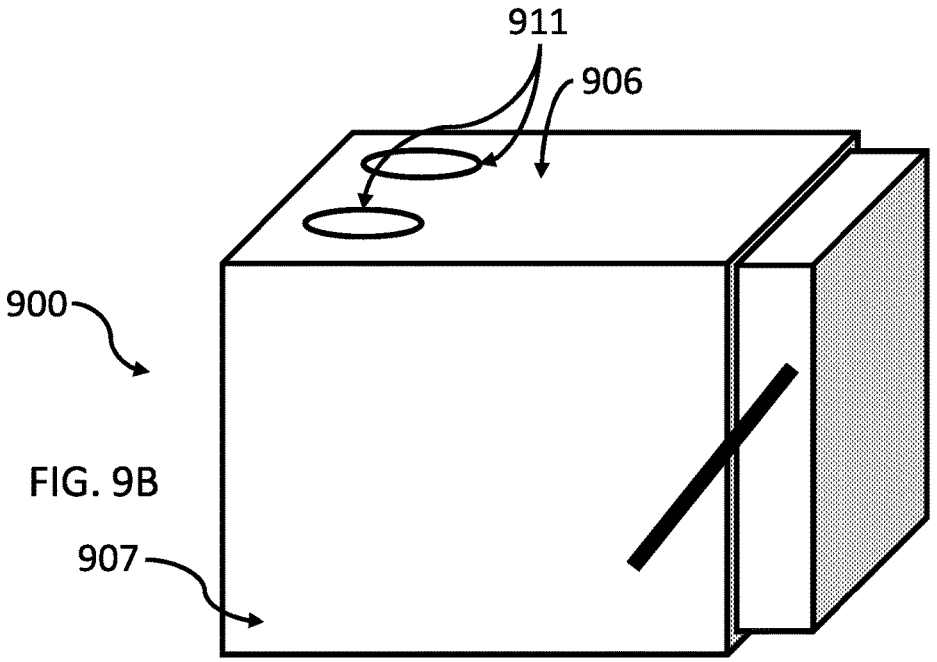

FIGS. 9A-B illustrate an example consumer product 900 according to this description. Consumer product 900 is open in FIG. 9A, closed in FIG. 9B. Consumer product 900 comprises a detergent product (not visible in these Figures) and a container, the container comprising a box 901, a cover 902 for the box, and a lock to reversibly maintain the cover in a closed position. In this example, the lock is not visible and is located in the area of actuation areas 911 when the cover is in the closed position. In this example, the cover 902 is in the form of a sleeve surrounding box 901. The box comprises the detergent product, the box comprising a base 904, sidewalls 905 and an opening, the opening 912 being in this example opposite the base. One should note that in this example and in other examples, the opening could be located on a sidewall and still be covered by the cover when the cover is in the closed position. The cover comprises a top 906 and flanks 907, the cover covering the opening 912 and the cover covering at least a specific portion of a specific sidewall of the box when the cover is in the closed position, whereby at least one of the flanks and sidewalls comprises an alignment mark 910 coinciding with the cover being in the closed position. In this example, the cover further comprises a cover bottom completing the sleeve. As illustrated in FIG. 9B, the alignment marks 110 coincide when the cover is closed by sliding the sleeve over the opening, such coincidence confirming closure of the container and thereby adequate protection of the content.

Figure 10A:
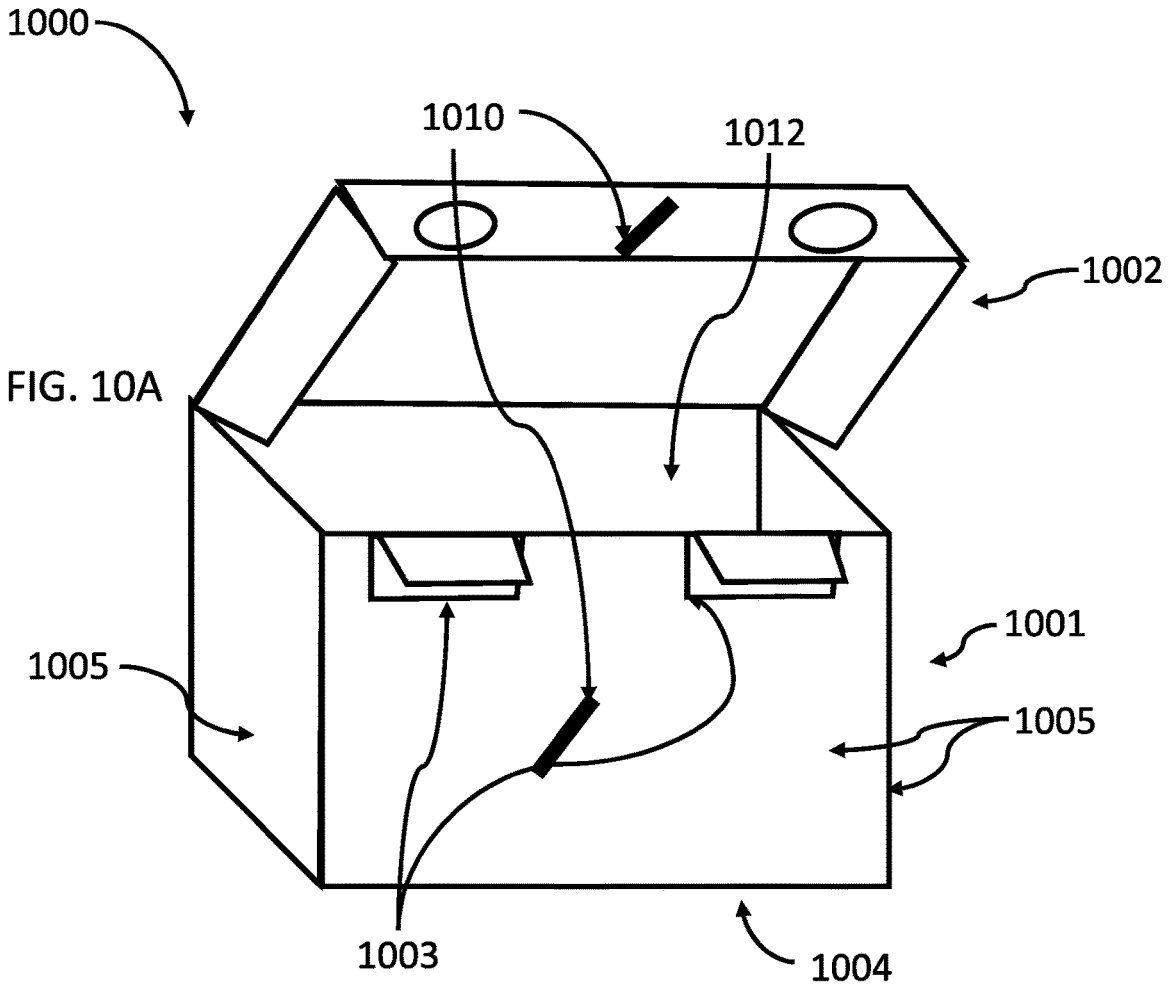
FIG. 10A-B illustrate a tenth example consumer product.
Figure 10B:
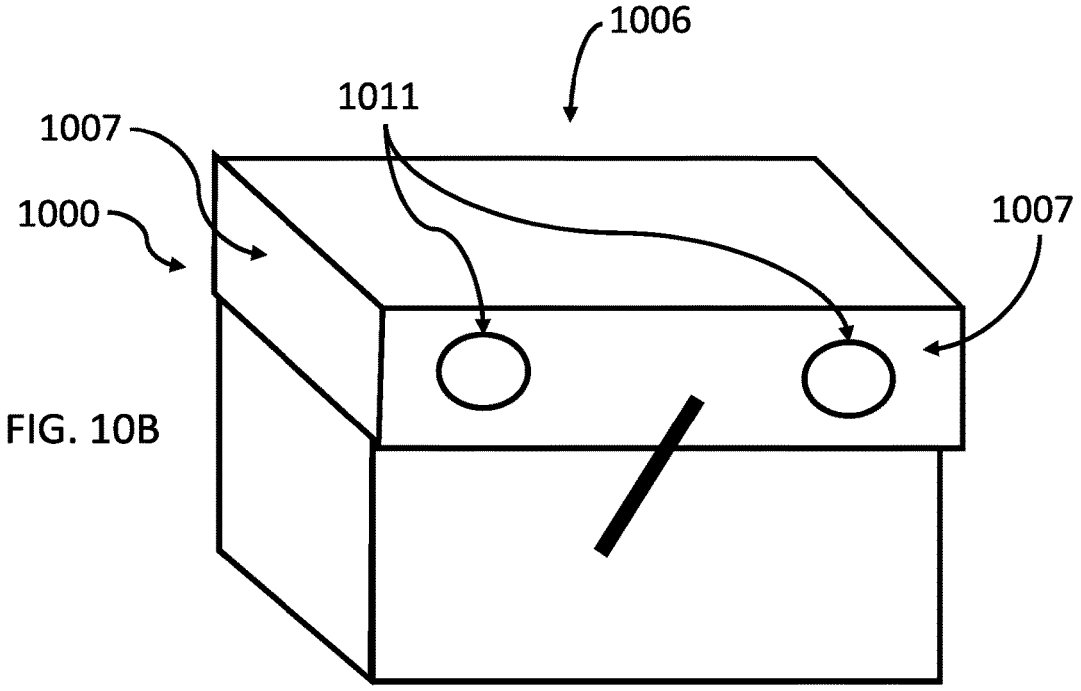

FIGS. 10A-B illustrate an example consumer product 1000 according to this description. Consumer product 1000 is open in FIG. 10A, closed in FIG. 10B. Consumer product 1000 comprises a detergent product (not visible in these Figures) and a container, the container comprising a box 1001, a cover 1002 for the box, and locks 1003 to reversibly maintain the cover in a closed position. In this example, two locks are provided on a same sidewall of the box and may be activated using actuation areas 1011. In this example, the cover 1002 is in the form of a hinged lid. The box comprises the detergent product, the box comprising a base 1004, sidewalls 1005 and an opening 1012, the opening 1012 being in this example opposite the base. The cover comprises a top 1006 and flanks 1007, the cover covering the opening 1012 and the cover covering at least a specific portion of a specific sidewall of the box when the cover is in the closed position, whereby at least one of the flanks and sidewalls comprises an alignment mark 1010 coinciding with the cover being in the closed position as illustrated in FIG. 10B.

Figure 11A:
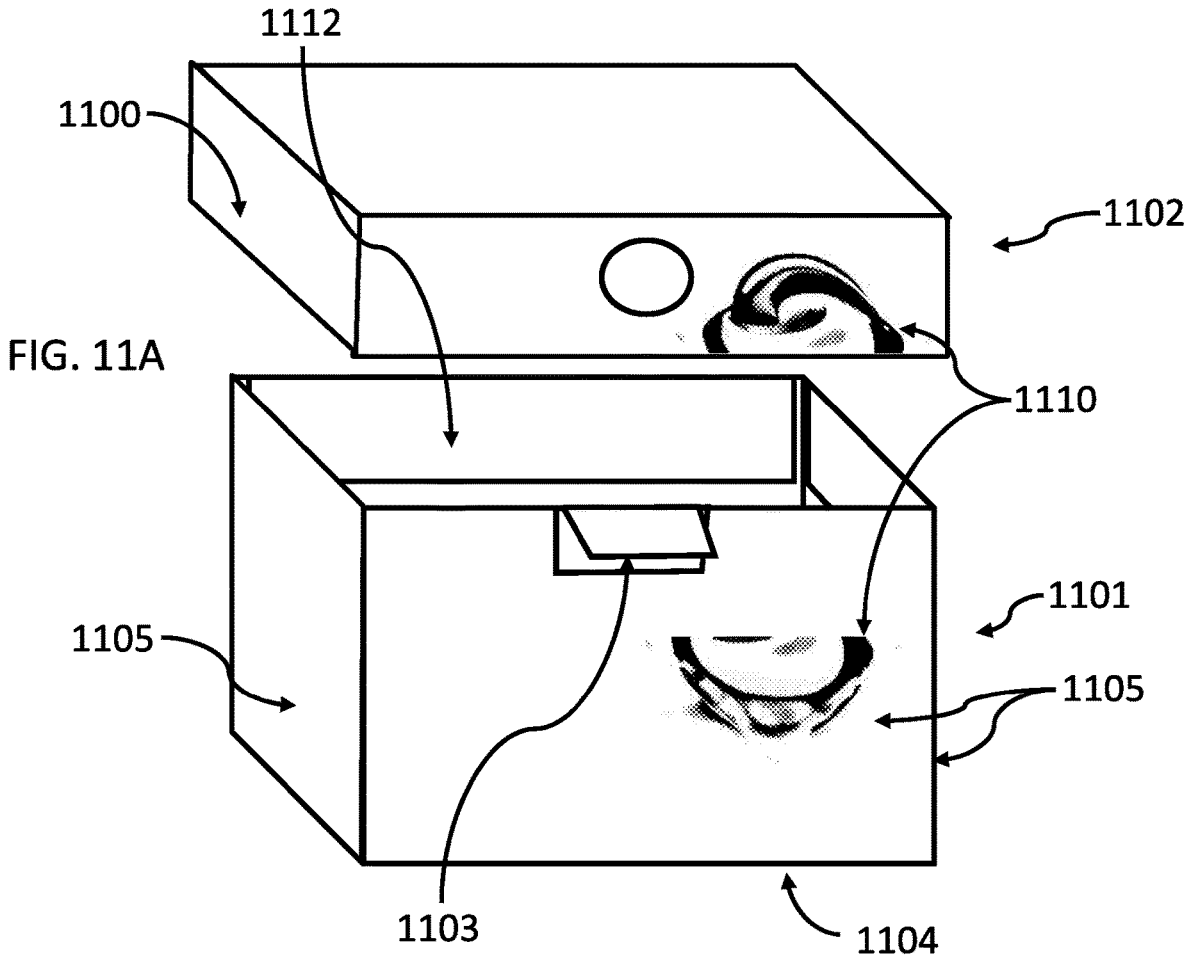
FIG. 11A-B illustrate an eleventh example consumer product.
Figure 11B:
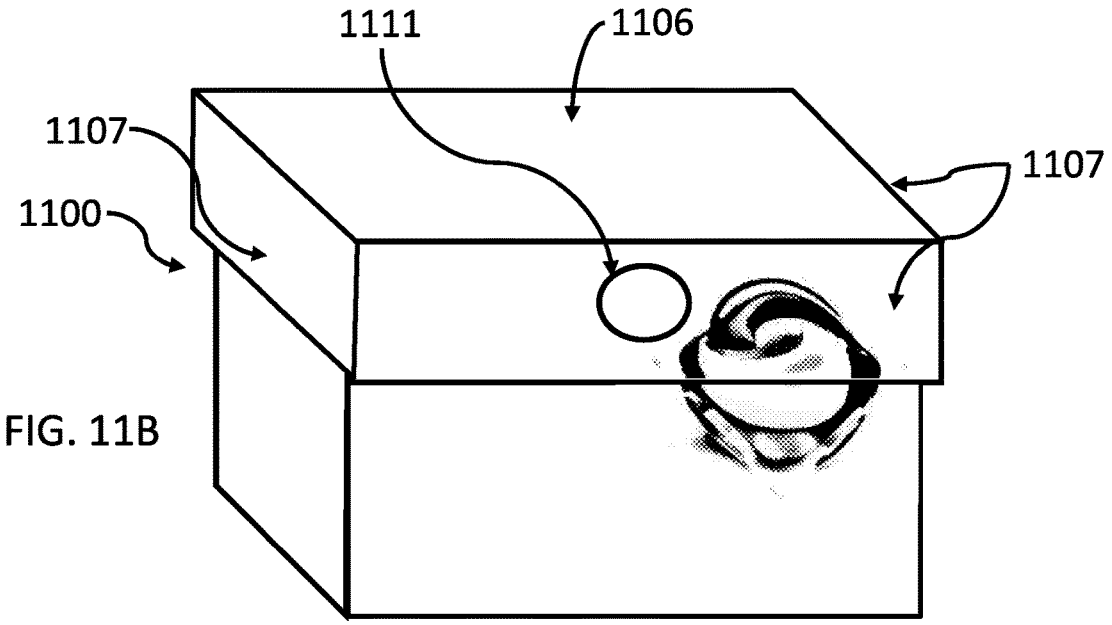

FIGS. 11A-B illustrate an example consumer product 1100 according to this description. Consumer product 1100 is open in FIG. 11A, closed in FIG. 11B. Consumer product 1100 comprises a detergent product (not visible in these Figures) and a container, the container comprising a box 1101, a cover 1102 for the box, and lock 1103 to reversibly maintain the cover in a closed position. In this example, locks 1103 may be activated using actuation areas 1111. The box comprises the detergent product, the box comprising a base 1104, sidewalls 1105 and an opening 1112, the opening 1112 being in this example opposite the base. The cover comprises a top 1106 and flanks 1107, the cover covering the opening 1112 and the cover covering at least a specific portion of a specific sidewall of the box when the cover is in the closed position, whereby at least one of the flanks and sidewalls comprises an alignment mark 1110 coinciding with the cover being in the closed position as illustrated in FIG. 11B. In this example detergent product comprises water-soluble unit dose articles, and the alignment mark 1110 comprises portions of a representation of a water-soluble unit dose article, the portions of the representation of the water-soluble unit dose article being complementary, the representation being completed by alignment of the alignment marks when the cover is closed.

As illustrated in some examples, the alignment mark may comprise both a flank alignment mark and a sidewall alignment mark, whereby the flank alignment mark and the sidewall alignment mark are aligned when the cover is in the closed position, the sidewall alignment mark preferably coinciding with at least one of a distal end of a flank, an aperture in a flank, and a see through area of a flank, when the cover is in the closed position.

As illustrated in some examples, the alignment mark may comprise a sidewall alignment mark, whereby the sidewall alignment mark is entirely covered by at least a region of the flanks when the cover is in the closed position.

As illustrated in some examples, at least one of the flanks and sidewalls may comprise one or more additional alignment marks coinciding with the cover being in the closed position, the one or more additional alignment marks and the alignment mark being preferably located on different sides of the container.

As illustrated in some examples, the consumer product may comprise one or more additional locks, the one or more additional locks being preferably located on one or more sides of the container corresponding to the one or more additional alignment marks.

As illustrated in some examples, the cover may be a lid covering the opening when the cover is in the closed position. The cover may be a hood type lid or a hinged lid.

As illustrated in some examples, the cover may be a sliding sleeve covering the opening, at least a portion of the base, and at least a portion of two sidewalls, when the cover is in the closed position.

As illustrated in some examples, the alignment mark may comprise one or more of a line, a set of lines, a letter, a word, a color patch, an arrow, a pattern, a usage instruction text, a usage instruction indication, and a picture. In some examples, the alignment mark comprises one or more of an icon or symbol representing for example a padlock, a lock or a fingerprint. In a specific example, the alignment mark is a fingerprint in the configuration of alignment mark 310 as per FIGS. 3A-C, the fingerprint acting both as alignment mark and as instruction to guide a user to apply pressure in the area of the actuation are 311 in order to unlock the container.

As illustrated in some examples, the container may be made from paper or cardboard materials.

As illustrated in some examples, the detergent product my take the form of unit dose detergent pouches, preferably in the form of flexible water soluble unit dose detergent pouches, and preferably whereby the alignment mark comprises a representation of a unit dose detergent pouch.

As illustrated in some examples, the consumer product may further comprise instructions on how to operate the lock.

As illustrated in some examples, the lock may comprise an actuator moveable from a locking position to an opening position by applying an actuation pressure onto the actuator when the cover is in the closed position, the actuator being connected to the specific portion, the flanks comprising an actuation area, the actuation area facing the actuator and permitting displacing the actuator from the closing position to the opening position by applying the actuation pressure at the actuation area when the cover is in the closed position, the actuator being moveable from the opening position to the closing position by the actuator releasing an elastic force, the release of the elastic force occurring when the cover is placed in a specific releasing position, the alignment mark coinciding with the cover being in the closed position passed the specific releasing position. In some such examples, the alignment mark may comprise an actuator alignment mark located on the actuator, whereby the actuation area is at least one of an aperture and a see-through actuation area, and whereby the actuator alignment mark becomes visible through the aperture or see-through actuation area when the cover is in the closed position passed the specific releasing position. In some such examples, the actuator alignment mark may be aligned with a flanks alignment mark when the cover is in the closed position passed the specific releasing position.

Figure 12:
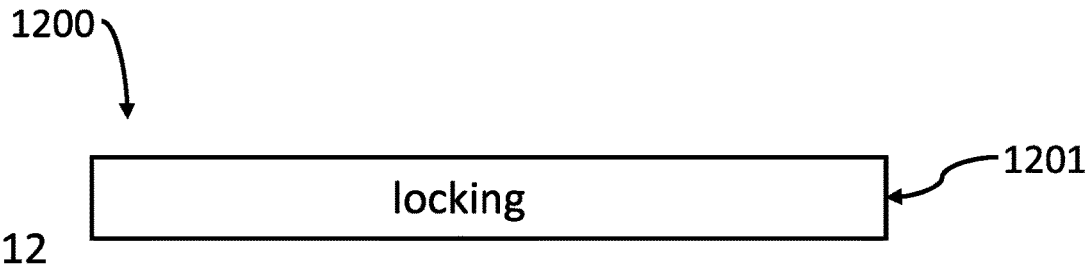
FIG. 12 illustrates a first example method.
Figure 13:
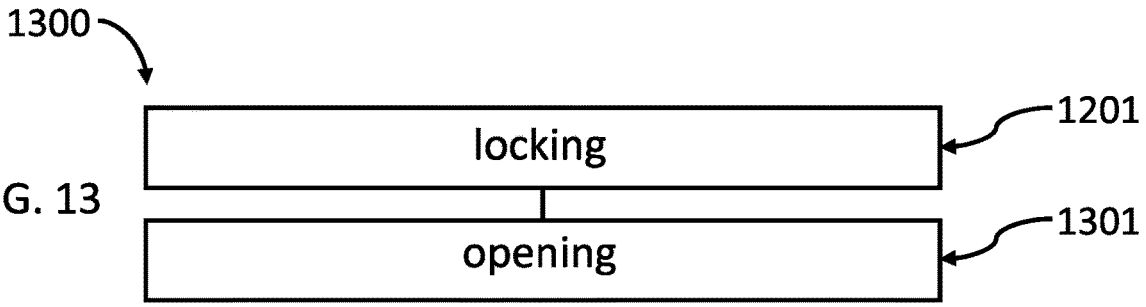
FIG. 13 illustrates a second example method.

FIG. 12 illustrates an example method 1200 of operating a consumer product according to any of the examples according to this disclosure, the method comprising in block 1201 locking the container by displacing the cover until the alignment mark coincides with the cover being in the closed position. In some examples, the displacement comprises a translation, for example in the case of a cover being a sleeve, or of a cover being a hood lid. The displacement may in some examples be vertical, or in some examples horizontal. In some examples, the displacement comprises a rotation, for example in cases where the cover is a hinged lid. In some examples, in particular cases whereby the container comprises an actuator releasing an elastic force, the release of the elastic force occurring when the cover is placed in a specific releasing position, the method comprises locking the container by displacing the cover until the alignment mark coincides with the cover being in the closed position passed the specific releasing position. In some specific examples, as illustrated in FIG. 13, an example method 1300, comprising block 1201 of example method 1200, further comprises in block 1301 opening the container by applying an actuation pressure onto the actuator and at the actuation area when the cover is in the closed position.

Figure 14:
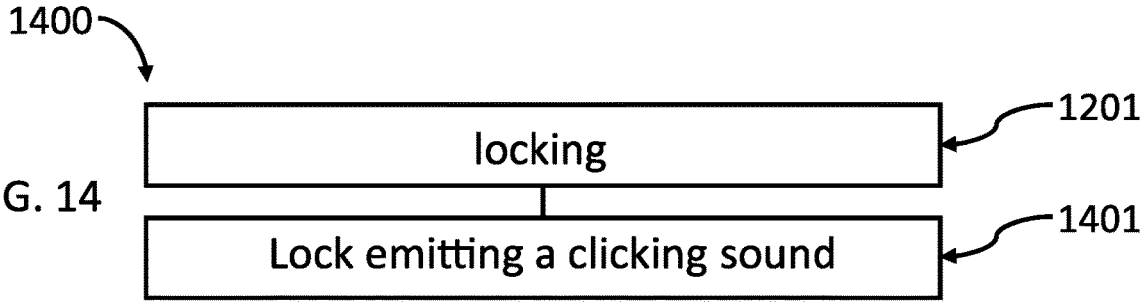
FIG. 14 illustrates a third example method.

As illustrated in FIG. 14, an example method 1400, comprising block 1201 as per example method 1200, may comprise the lock emitting a clicking sound upon locking as per block 1401. This would permit confirming closure both through a visual or tactile feedback provided by the alignment mark, and by the clicking sound.

The present disclosure also aims at resolving an apparent contradiction between, on one hand, the use of materials for the sidewalls which would resist accidental opening, and the use of materials for the sidewalls which are particularly environmentally friendly.

The container may indeed be made from paper or cardboard material, in particular rigid cardboard material, flexible cardboard material or a mixture thereof. In some example, the material forming the box or the cover has a wall thickness of more than 220 microns and of less than 3 mm. In some example, the material forming the box or the cover has a wall thickness of more than 1 mm and of less than 2 mm. In some example, the material forming the box or the cover is folded on itself, for example to reinforce parts of or the whole of the box or the cover. The container may be made from paper materials, bio based material, bamboo fibres, cellulose fibres, cellulose based or fibre based materials, or a mixture thereof. The container may be made from materials comprising recycled materials, for example recycled cellulose fiber based materials. In some examples, in order to facilitate opening, the cover may be entirely separated from the box when open, and the cover weighs less than 200 g, preferably less than 100 g, even more preferably less than 80 g, and more than 10 g, more preferably more than 30 g, even more preferably more than 40 g, in order to obtain a sufficiently robust cover structure.

In some examples where the cover is in the form of a lid, the cover according to some examples comprises a support element structure, the support element structure entering the opening of the box when the cover is in the closed position, at least part of the specific portion of the sidewalls being located between the flanks and the support element structure when the cover is in the closed position, a clearance distance separating the sidewalls from the support element structure in a direction normal to the specific portion of the sidewalls when the cover is in the closed position and when no actuation pressure is applied, the clearance distance being reduced to zero by flexing of the specific portion of the sidewalls when the actuation pressure is applied above a pressure threshold when the cover is in the closed position. Both the support element structure and the flanks are structurally part of the cover, the support element structure and the flanks permitting sandwiching the specific portion of the sidewall, thereby preventing sinking in of the specific portion of the sidewall and undesired disengagement of the actuator from the locking tab. It is important to take note of the fact that in case of an actuation pressure being applied while lifting the box through the cover, the pressure applied will catch the sandwiched specific portion of the sidewall against the support element structure, thereby compensating a force of gravity which would otherwise disconnect the cover from the box, such compensation of the gravity force being through a resisting static friction force between the specific portion of the sidewall and the support element structure. In some examples, the use of the support element structure permits using for making the box a relatively flexible material, whereby such flexible material would flex in the absence of the support element structure to the point that the box would fall off if lifted by its cover. Permitting using a relatively flexible material also permits using a lesser quantity of such material due to the presence of the support element structure which compensates for such flexibility. The presence of such support element structure thereby prevents or reduces the risk of accidental opening even if the actuation pressure is applied onto the actuator of the lock, for example as the box is lifted while applying pressure on the actuator of the lock.

The support element structure enters the opening when the cover is in the closed position, fitting within the box when the cover is in the closed position. Such entering the opening should be understood in that the support element structure comprises a support element structure portion which enters the opening when the cover is moved from the open to the closed position, and whereby such support element structure portion exits the opening when the cover is moved from the closed to the open position. At least part of the specific portion of the sidewalls is located between the flanks and the support element structure when the cover is in the closed position. This structure permits capturing the specific portion of the sidewall between the flanks and the support element structure, the specific portion of the sidewall getting inserted between the flanks and the support element structure when the cover moves from the open to the closed position, the specific portion of the side wall being released from between the flanks and the support element structure when the cover moves from the closed to the open position. A clearance distance separates the sidewalls from the support element structure in a direction normal to the specific portion of the sidewalls when the cover is in the closed position, such direction corresponding for example to a direction of a linear ridge of the support element, and when no actuation pressure is applied. Such clearance distance would exist on a first side, and be repeated additionally on a second side of the support element structure. Such clearance distance permits insertion of the support element structure through the opening as the cover gets closed, such that the support element structure does not collide with the specific portion of the sidewall when the cover gets closed. The clearance is reduced to zero by flexing of the specific portion of the sidewalls when the actuation pressure is applied above a pressure threshold when the cover is in the closed position. When such pressure threshold is reached, the sidewall lays against the support element structure through the clearance distance being reduced to zero, the sidewall thereby being prevented from being exceedingly distorted and being prevented from sinking in to the point of the actuator releasing the locking tab. The clearance distance according to such examples relates in some examples to a tolerance distance between the cover and the box which both permits placing the cover onto the box without undue difficulty, while avoiding that the cover be loose when in the closed position. While the clearance distance according to this disclosure is considered in a region of the lock, the tolerance distance between the cover and the box may be considered along an entire perimeter of the opening of the box. In some examples, the tolerance is of at least 0.1 mm and of less than 5 mm. In some examples the tolerance is of at least 0.5 mm and of less than 3 mm. Such tolerance would for example be measured when the cover is in the closed position and between an internal surface of the flanks and an external surface of the sidewalls, understanding that such tolerance may take a different value in a region of the lock.

In some examples, the clearance distance is of at least 1 mm and of less than 1 cm when the cover is in the closed position and no actuation pressure is applied. Such a range permits both easing the closing of the cover and preventing sinking of the specific portion of the sidewall leading to undesired unlocking. In some examples, the clearance distance is of at least 1.5 mm and of less than 0.5 cm when the cover is in the closed position and no actuation pressure is applied. In some examples, the clearance distance is of at least 2 mm and of less than 0.4 cm when the cover is in the closed position and no actuation pressure is applied.

In some examples, the cover comprises a corrugated cardboard layer, the corrugated cardboard layer comprising flutes, the flutes preferably running parallel to the direction normal to the specific portion and parallel to a top of the cover, and whereby the actuation area preferably intersect at least some of the flutes. Such a structure permits reinforcing the top of the cover. The intersecting of flutes by an actuation area in the form of an aperture also permits ventilating the flank or flanks in which the aperture is provided, thereby reinforcing flank integrity in humid environments.

In some examples the detergent product comprises a detergent composition. The detergent composition may be a laundry detergent composition, an automatic dishwashing composition, a hard surface cleaning composition, or a combination thereof. The detergent composition may comprise a solid, a liquid or a mixture thereof. The term liquid includes a gel, a solution, a dispersion, a paste, or a mixture thereof. The solid may be a powder. By powder we herein mean that the detergent composition may comprise solid particulates or may be a single homogenous solid. In some examples, the powder detergent composition comprises particles. This means that the powder detergent composition comprises individual solid particles as opposed to the solid being a single homogenous solid. The particles may be free-flowing or may be compacted. A laundry detergent composition can be used in a fabric hand wash operation or may be used in an automatic machine fabric wash operation, for example in an automatic machine fabric wash operation. Example laundry detergent compositions comprise a non-soap surfactant, wherein the non-soap surfactant comprises an anionic non-soap surfactant and a non-ionic surfactant. In some examples, the laundry detergent composition comprises between 10% and 60%, or between 20% and 55% by weight of the laundry detergent composition of the non-soap surfactant. Example weight ratio of non-soap anionic surfactant to nonionic surfactant are from 1:1 to 20:1, from 1.5:1 to 17.5:1, from 2:1 to 15:1, or from 2.5:1 to 13:1. Example non-soap anionic surfactants comprises linear alkylbenzene sulphonate, alkyl sulphate or a mixture thereof. Example weight ratio of linear alkylbenzene sulphonate to alkyl sulphate are from 1:2 to 9:1, from 1:1 to 7:1, from 1:1 to 5:1, or from 1:1 to 4:1. Example linear alkylbenzene sulphonates are $C_{10}$-$C_{16}$ alkyl benzene sulfonic acids, or $C_{11}$-$C_{14}$ alkyl benzene sulfonic acids. By 'linear', we herein mean the alkyl group is linear. Example alkyl sulphate anionic surfactant may comprise alkoxylated alkyl sulphate or non-alkoxylated alkyl sulphate or a mixture thereof. Example alkoxylated alkyl sulphate anionic surfactant comprise an ethoxylated alkyl sulphate anionic surfactant. Example alkyl sulphate anionic surfactant may comprise an ethoxylated alkyl sulphate anionic surfactant with a mol average degree of ethoxylation from 1 to 5, from 1 to 3, or from 2 to 3. Example alkyl sulphate anionic surfactant may comprise a non-ethoxylated alkyl sulphate and an ethoxylated alkyl sulphate wherein the mol average degree of ethoxylation of the alkyl sulphate anionic surfactant is from 1 to 5, from 1 to 3, or from 2 to 3. Example alkyl fraction of the alkyl sulphate anionic surfactant are derived from fatty alcohols, oxo-synthesized alcohols, Guerbet alcohols, or mixtures thereof. In some examples, the laundry detergent composition comprises between 10% and 50%, between 15% and 45%, between 20% and 40%, or between 30% and 40% by weight of the laundry detergent composition of the non-soap anionic surfactant. In some examples, the non-ionic surfactant is selected from alcohol alkoxylate, an oxo-synthesised alcohol alkoxylate, Guerbet alcohol alkoxylates, alkyl phenol alcohol alkoxylates, or a mixture thereof. In some examples, the laundry detergent composition comprises between 0.01% and 10%, between 0.01% and 8%, between 0.1% and 6%, or between 0.15% and 5% by weight of the liquid laundry detergent composition of a non-ionic surfactant. In some examples, the laundry detergent composition comprises between 1.5% and 20%, between 2% and 15%, between 3% and 10%, or between 4% and 8% by weight of the laundry detergent composition of soap, in some examples a fatty acid salt, in some examples an amine neutralized fatty acid salt, wherein in some examples the amine is an alkanolamine for example selected from monoethanolamine, diethanolamine, triethanolamine or a mixture thereof, in some examples monoethanolamine. In some examples, the laundry detergent composition is a liquid laundry detergent composition. In some examples the liquid laundry detergent composition comprises less than 15%, or less than 12% by weight of the liquid laundry detergent composition of water. In some examples, the laundry detergent composition is a liquid laundry detergent composition comprising a non-aqueous solvent selected from 1,2-propanediol, dipropylene glycol, tripropyleneglycol, glycerol, sorbitol, polyethylene glycol or a mixture thereof. In some examples, the liquid laundry detergent composition comprises between 10% and 40%, or between 15% and 30% by weight of the liquid laundry detergent composition of the non-aqueous solvent. In some examples, the laundry detergent composition comprises a perfume. In some examples, the laundry detergent composition comprises an adjunct ingredient selected from the group comprising builders including enzymes, citrate, bleach, bleach catalyst, dye, hueing dye, brightener, cleaning polymers including alkoxylated polyamines and polyethyleneimines, soil release polymer, surfactant, solvent, dye transfer inhibitors, chelant, encapsulated perfume, polycarboxylates, structurant, pH trimming agents, and mixtures thereof. In some examples, the laundry detergent composition has a pH between 6 and 10, between 6.5 and 8.9, or between 7 and 8, wherein the pH of the laundry detergent composition is measured as a 10% product concentration in demineralized water at 20° C. When liquid, the laundry detergent composition may be Newtonian or non-Newtonian. In some examples, the liquid laundry detergent composition is non-Newtonian. Without wishing to be bound by theory, a non-Newtonian liquid has properties that differ from those of a Newtonian liquid, more specifically, the viscosity of non-Newtonian liquids is dependent on shear rate, while a Newtonian liquid has a constant viscosity independent of the applied shear rate. The decreased viscosity upon shear application for non-Newtonian liquids is thought to further facilitate liquid detergent dissolution. The liquid laundry detergent composition described herein can have any suitable viscosity depending on factors such as formulated ingredients and purpose of the composition.

In some examples, the consumer product comprises at least one water-soluble unit dose article and the container. The consumer product can be sold 'as is', in other words the consumer product is the item that the consumer picks up from the shelf. Alternatively, the consumer product could be housed as one unit of a multi-component product. For example, more than one consumer product could be housed within an outer package and the multiple packaged consumer products sold together in a single purchase. The consumer product may comprise aesthetic elements, for example shrink sleeves or labels attached to the container. Alternatively, the container may be coloured or printed with aesthetic elements or informative print such as usage instructions.

In some examples a water-soluble unit dose article comprises at least one water-soluble film orientated to create at least one-unit dose internal compartment, wherein the at least one-unit dose internal compartment comprises a detergent composition. The water-soluble film and the detergent composition are described in more detail below. In some examples the consumer product comprises at least one water-soluble unit dose article, in some cases at least two water-soluble unit dose articles, in some cases at least 10 water-soluble unit dose articles, in some cases at least 20 water-soluble unit dose articles, in some cases at least 30 water-soluble unit dose articles, in some cases at least 40 water-soluble unit dose articles, in some cases at least 45 water-soluble unit dose articles. A water-soluble unit dose article is in some examples in the form of a pouch. A water-soluble unit dose article comprises in some examples a unitary dose of a composition as a volume sufficient to provide a benefit in an end application. The water-soluble unit dose article comprises in some examples one water-soluble film shaped such that the unit-dose article comprises at least one internal compartment surrounded by the water-soluble film. The at least one compartment comprises a cleaning composition. The water-soluble film is sealed such that the cleaning composition does not leak out of the compartment during storage. However, upon addition of the water-soluble unit dose article to water, the water-soluble film dissolves and releases the contents of the internal compartment into the wash liquor. The unit dose article may comprise more than one compartment, at least two compartments, or at least three compartments, or at least four compartments, or even at least five compartments. The compartments may be arranged in superposed orientation, i.e. one positioned on top of the other. Alternatively, the compartments may be positioned in a side-by-side orientation, i.e. one orientated next to the other. The compartments may be orientated in a 'tyre and rim' arrangement, i.e. a first compartment is positioned next to a second compartment, but the first compartment at least partially surrounds the second compartment, but does not completely enclose the second compartment. Alternatively, one compartment may be completely enclosed within another compartment. In some examples the unit dose article comprises at least two compartments, one of the compartments being smaller than the other compartment. In some examples the unit dose article comprises at least three compartments, two of the compartments may be smaller than the third compartment, and in some examples the two smaller compartments being superposed on the larger compartment. In some examples the unit dose article comprises at least four compartments, three of the compartments may be smaller than the fourth compartment, and in some examples the three smaller compartments being superposed on the larger compartment. The superposed compartments are in some examples orientated side-by-side. In some examples each individual unit dose article may have a weight of between 10 g and 40 g, or even between 15 g and 35 g. The water soluble film may be soluble or dispersible in water. Prior to be being formed into a unit dose article, the water-soluble film has in some examples a thickness of from 20 to 150 micron, in other examples 35 to 125 micron, in further examples 50 to 110 micron, in yet further examples about 76 micron. Example water soluble film materials comprise polymeric materials. The film material can, for example, be obtained by casting, blow-moulding, extrusion or blown extrusion of the polymeric material. In some examples, the water-soluble film comprises polyvinyl alcohol polymer or copolymer, for example a blend of polyvinylalcohol polymers and/or polyvinylalcohol copolymers, for example selected from sulphonated and carboxylated anionic polyvinylalcohol copolymers especially carboxylated anionic polyvinylalcohol copolymers, for example a blend of a polyvinylalcohol homopolymer and a carboxylated anionic polyvinylalcohol copolymer. In some examples water soluble films are those supplied by Monosol under the trade references M8630, M8900, M8779, M8310. In some examples the film may be opaque, transparent or translucent. The film may comprise a printed area. The area of print may be achieved using techniques such as flexographic printing or inkjet printing. The film may comprise an aversive agent, for example a bittering agent. Suitable bittering agents include, but are not limited to, naringin, sucrose octaacetate, quinine hydrochloride, denatonium benzoate, or mixtures thereof. Example levels of aversive agent include, but are not limited to, 1 to 5000 ppm, 100 to 2500 ppm, or 250 to 2000 ppm. The water-soluble film or water-soluble unit dose article or both may be coated with a lubricating agent. In some examples, the lubricating agent is selected from talc, zinc oxide, silicas, siloxanes, zeolites, silicic acid, alumina, sodium sulphate, potassium sulphate, calcium carbonate, magnesium carbonate, sodium citrate, sodium tripolyphosphate, potassium citrate, potassium tripolyphosphate, calcium stearate, zinc stearate, magnesium stearate, starch, modified starches, clay, kaolin, gypsum, cyclodextrins or mixtures thereof.

In some examples the container comprises a first part, wherein the first part comprises a first compartment in which the at least one water-soluble unit dose article is contained. In some examples the first compartment comprises at least two water-soluble unit dose articles. The first compartment may comprise between 1 and 80 water-soluble unit dose articles, between 1 and 60 water-soluble unit dose articles, between 1 and 40 water-soluble unit dose articles, or between 1 and 20 water-soluble unit dose articles. The volume of the first compartment may be between 500 ml and 5000 ml, in some examples between 800 ml and 4000 ml.

In some examples, the detergent product is in the form of unit dose detergent pouches, preferably in the form of flexible water soluble unit dose detergent pouches, whereby the aperture is configured to prevent a unit dose detergent pouch from passing through the aperture. Having the aperture configured to prevent a unit dose detergent pouch from passing through the aperture permits avoiding spilling detergent pouches accidentally through the aperture. In some examples, the pouches have a minimum cross section, such minimum cross section being in some cases surrounded by an external flange area, such minimum cross section intersecting an internal volume of the detergent article comprising the detergent, such minimum cross section being of less than the actuation area aperture. For example, if the actuation area aperture is of 1 $cm^2$, pouches having a minimum cross section of 1.5 $cm^2$ will not spill through the aperture.

In some examples, one or more flank of the flanks comprising an actuation area covers at least 10%, preferable at least 20%, more preferably at least 30% of one or more respective sidewall of the sidewalls when the cover is in the closed position. In such examples, if the respective actuation area is an aperture, such aperture will to some degree permit evacuating air comprised in the cover while closing the cover as the cover slides onto the box. In some examples, the cover defines a cover internal volume delimited by the top of the cover and the flanks. In some examples the cover internal volume is comprised between 200 and 2000 $cm^3$, preferably between 750 $cm^3$ and 1500 $cm^3$. In some examples, one or more flank of the flanks comprising a respective actuation area covers at least 40% of one or more respective sidewall of the sidewalls when the cover is in the closed position. In some examples, one or more flank of the flanks comprising a respective actuation area covers at least 50% of one or more respective sidewall of the sidewalls when the cover is in the closed position. Providing a higher flank coverage increases robustness and permits holding the content of the container in the cover case of an accidental upside down opening. Such configurations may be advantageously combined in some examples with an aperture configured to prevent a unit dose detergent pouch from passing through the aperture.

In some examples, the actuation area covers less than 6 $cm^2$ and more than 1 $cm^2$. Such dimensioning was also found particularly effective at applying a high precision force or pressure.

In some examples, the flanks comprising two short flanks and two long flanks, whereby the actuation area is on a long flank. This configuration permits increasing rigidity of the top of the cover, while maintaining a desired container inner volume. The cover may indeed comprise two opposite long flanks parallel to each other and two opposite short flanks parallel to each other, the long flanks being perpendicular to the short flanks, the long flanks being preferably reinforced, in order to take into account the fact that a user or consumer may be more likely to apply pressure on long flanks, and that long flanks are more likely to be submitted to deformation given that their middle point along the first direction is farther away from corners of the same long flank than the middle point of a short flank from the respective short flank corners.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm".

Every document cited herein, including any cross referenced or related patent or application and any patent application or patent to which this application claims priority or benefit thereof, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

[Last paragraph before the claims] While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A consumer product comprising a detergent product and a container, the container comprising a box, a cover for the box, and a lock to reversibly maintain the cover in a closed position, the box comprising the detergent product, the box comprising a base, sidewalls and an opening, the cover comprising a top and flanks, the cover covering the opening and the cover covering at least a specific portion of a specific sidewall of the box when the cover is in a closed position, whereby at least one of the flanks and sidewalls comprises an alignment mark coinciding with the cover being in the closed position, whereby the alignment mark comprises both a flank alignment mark and a sidewall alignment mark, whereby the flank alignment mark and the sidewall alignment mark coincide to be both visible and aligned when the cover is in the closed position, whereby the lock is engaged by displacing the cover through rotation; wherein at least one of the flanks and sidewalls comprises one or more additional alignment marks coinciding with the cover being in the closed position, and wherein the one or more additional alignment marks and the alignment mark are located on different sides of the container.

2. The consumer product according to claim 1, wherein the sidewall alignment mark coincides with at least one of a distal end of a flank, an aperture in a flank, and a see-through area of a flank, when the cover is in the closed position.

3. The consumer product according to claim 1, whereby the alignment mark comprises a second sidewall alignment mark, wherein the second sidewall alignment mark is entirely covered by at least a region of the flanks when the cover is in the closed position.

4. The consumer product according to claim 1, the consumer product comprising one or more additional locks, the one or more additional locks being located on one or more sides of the container corresponding to the one or more additional alignment marks.

5. The consumer product according to claim 1, wherein the cover is a lid covering the opening when the cover is in the closed position.

6. The consumer product according to claim 1, wherein the alignment mark comprises one or more of a line, a set of lines, a letter, a word, a color patch, an arrow, a pattern, a usage instruction text, a usage instruction indication, and a picture.

7. The consumer product according to claim 1, wherein the container is made from paper or cardboard materials.

8. The consumer product according to claim 1, wherein the detergent product is in the form of unit dose detergent pouches.

9. The consumer product according to claim 1, the consumer product comprising instructions on how to operate the lock.

10. A method of operating a consumer product according to claim 1, the method comprising locking the container by displacing the cover until the alignment mark coincides with the cover being in the closed position.

11. The method according to claim 10, wherein the displacement comprises a translation.

12. The method according to claim 10, the method comprising the lock emitting a clicking sound upon locking.

13. A consumer product comprising a detergent product and a container, the container comprising a box, a cover for the box, and a lock to reversibly maintain the cover in a closed position, the box comprising the detergent product, the box comprising a base, sidewalls and an opening, the cover comprising a top and flanks, the cover covering the opening and the cover covering at least a specific portion of a specific sidewall of the box when the cover is in a closed position, whereby at least one of the flanks and sidewalls comprises an alignment mark coinciding with the cover being in the closed position, whereby the alignment mark comprises both a flank alignment mark and a sidewall alignment mark, whereby the flank alignment mark and the sidewall alignment mark coincide to be both visible and aligned when the cover is in the closed position, whereby the lock is engaged by displacing the cover through rotation, wherein the lock comprising an actuator moveable from a locking position to an opening position by applying an actuation pressure onto the actuator when the cover is in the closed position, the actuator being connected to the specific portion, the flanks comprising an actuation area, the actuation area facing the actuator and permitting displacing the actuator from the closing position to the opening position by applying the actuation pressure at the actuation area when the cover is in the closed position, the actuator being moveable from the opening position to the closing position by the actuator releasing an elastic force, the release of the elastic force occurring when the cover is placed in a specific releasing position, the alignment mark coinciding with the cover being in the closed position passed the specific releasing position, wherein the alignment mark comprises an actuator alignment mark located on the actuator, whereby the actuation area is at least one of an aperture and a see-through actuation area, and whereby the actuator alignment mark becomes visible through the aperture or see-through actuation area when the cover is in the closed position passed the specific releasing position.

14. The consumer product according to claim 13, wherein the actuator alignment mark is aligned with a flanks alignment mark when the cover is in the closed position passed the specific releasing position.

* * * * *